US011089898B2

(12) United States Patent
Vizcarrondo

(10) Patent No.: US 11,089,898 B2
(45) Date of Patent: Aug. 17, 2021

(54) SHOE TIE ASSISTING DEVICE

(71) Applicant: Lace Up Enterprises LLC, Euclid, OH (US)

(72) Inventor: Luis R. Vizcarrondo, Euclid, OH (US)

( * ) Notice: Subject to any disclaimer, the term of this patent is extended or adjusted under 35 U.S.C. 154(b) by 230 days.

(21) Appl. No.: 16/408,034

(22) Filed: May 9, 2019

(65) Prior Publication Data

US 2020/0352375 A1 Nov. 12, 2020

(51) Int. Cl.
*A47G 25/90* (2006.01)
*E06C 1/39* (2006.01)

(52) U.S. Cl.
CPC ..... *A47G 25/90* (2013.01); *E06C 1/39* (2013.01)

(58) Field of Classification Search
CPC .... A47G 25/90; A47G 25/905; A47G 25/907; A47G 25/92; A47G 25/84; A47G 25/845; A47G 25/86; E06C 1/39; E06C 1/38; E06C 1/383; E06C 1/393; A47C 16/00; A47C 16/02; A47C 16/026; A47L 23/16; A47L 23/17; A61H 3/04
USPC ..... D6/349, 350; D25/65
See application file for complete search history.

(56) References Cited

U.S. PATENT DOCUMENTS 231,529 A * 8/1880 Boyington ..... E06C 1/393 182/106
1,767,708 A * 6/1930 Simpson ..... A47C 7/64 297/188.03
D157,436 S 2/1950 Rogers
2,793,800 A * 5/1957 Hudd ..... A47C 12/02 182/33
3,126,565 A 3/1964 Miller
3,142,355 A 7/1964 Danielson et al.
5,137,240 A 8/1992 Van Meter
5,454,771 A 10/1995 Wilson-Hyde
6,145,931 A * 11/2000 Subotic ..... A47C 7/506 297/423.2
D473,722 S 4/2003 Rover
6,571,915 B1 6/2003 de la Tour
6,926,119 B1 8/2005 Schrock
7,052,030 B2 * 5/2006 Serhan ..... A61H 3/04 280/304.1
8,166,987 B2 * 5/2012 Weaver ..... A61G 5/14 135/67

(Continued)

FOREIGN PATENT DOCUMENTS

EP 978244 A1 * 2/2000

*Primary Examiner* — Ismael Izaguirre
(74) *Attorney, Agent, or Firm* — Pearne & Gordon LLP

(57) ABSTRACT

There is provided a shoe tie-assisting device that allows a user to position themselves such that they can tie their own shoes. The shoe tie assisting device includes a frame assembly that includes support columns spaced to create a geometric space between them. The support columns are connected with support bars. The shoe tie-assisting device further includes a platform assembly positioned in the geometric space between the support columns. The platform assembly allows a user to place one of their feet thereon. The shoe tie-assisting device further includes a handle assembly having one or more components that the user can grasp. This component(s) are positioned at height that a user can grasp them from an upright position without having to bend over. Using the platform assembly and handle assembly, a user can position their body such that they can tie their own shoes.

17 Claims, 17 Drawing Sheets

(56) References Cited

U.S. PATENT DOCUMENTS

| | | | | |
|---|---|---|---|---|
| 8,616,652 | B1 * | 12/2013 | Wells | A47C 16/025<br>297/423.39 |
| 8,936,262 | B2 * | 1/2015 | Nabeta | A61H 3/04<br>280/87.021 |
| 2016/0060957 | A1 * | 3/2016 | Onobrakpeya | E06C 1/393<br>182/106 |

* cited by examiner

SHOE TIE ASSISTING DEVICE

BACKGROUND

For people having certain health issues, some common, everyday tasks such as putting on and tying one's own shoes, is difficult to achieve. Putting on and tying shoes is particularly difficult for people with difficulty bending over or difficult bending over while maintaining their balance. Thus, such a person typically requires assistance from another person to complete such tasks. However, some people do not like to be dependent on others for what is for most people a simple task. Thus, there is a need for a device that allows a person with difficulty reaching their own feet to put on their own shoes to put on and tie their shoes without requiring assistance from another person.

U.S. Pat. No. 6,571,915 discloses a ladder for people with limited mobility. Example uses of the ladder include a person maneuvering between a wheelchair and a surface as shown in FIGS. 5-10 and a person moving from a surface to a standing position as shown in FIGS. 18-27. However, as shown in FIGS. 25-27, a person is required to bend over in order to reach the ladder, which is difficult to do for people with certain health issues.

SUMMARY

There is provided a shoe tie-assisting device that allows a user to position themselves such that they can tie their own shoes. The shoe tie assisting device includes a frame assembly that includes support columns spaced to create a geometric space between them. The support columns are connected with support bars. The shoe tie-assisting device further includes a platform assembly positioned in the geometric space between the support columns. The platform assembly allows a user to place one of their feet thereon. The shoe tie-assisting device further includes a handle assembly having one or more components that the user can grasp. This component(s) are positioned at height that a user can grasp them from an upright position without having to bend over. Using the platform assembly and handle assembly, a user can position their body such that they can tie their own shoes.

DETAILED DESCRIPTION OF PREFERRED EMBODIMENTS

First Embodiment

Figure 1A:
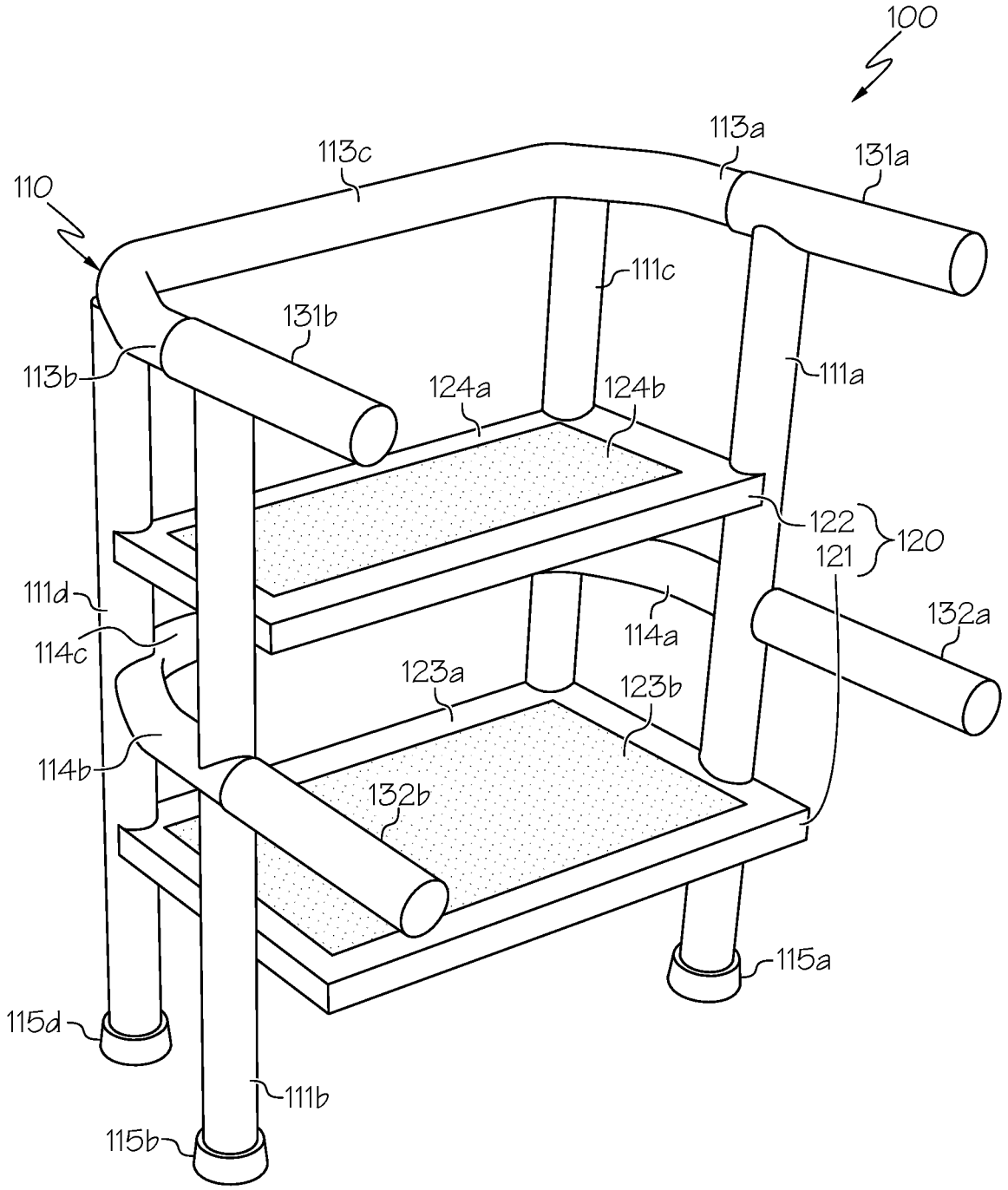
FIG. 1A depicts an isometric view of a shoe tie-assisting device according to a first embodiment.
Figure 1B:
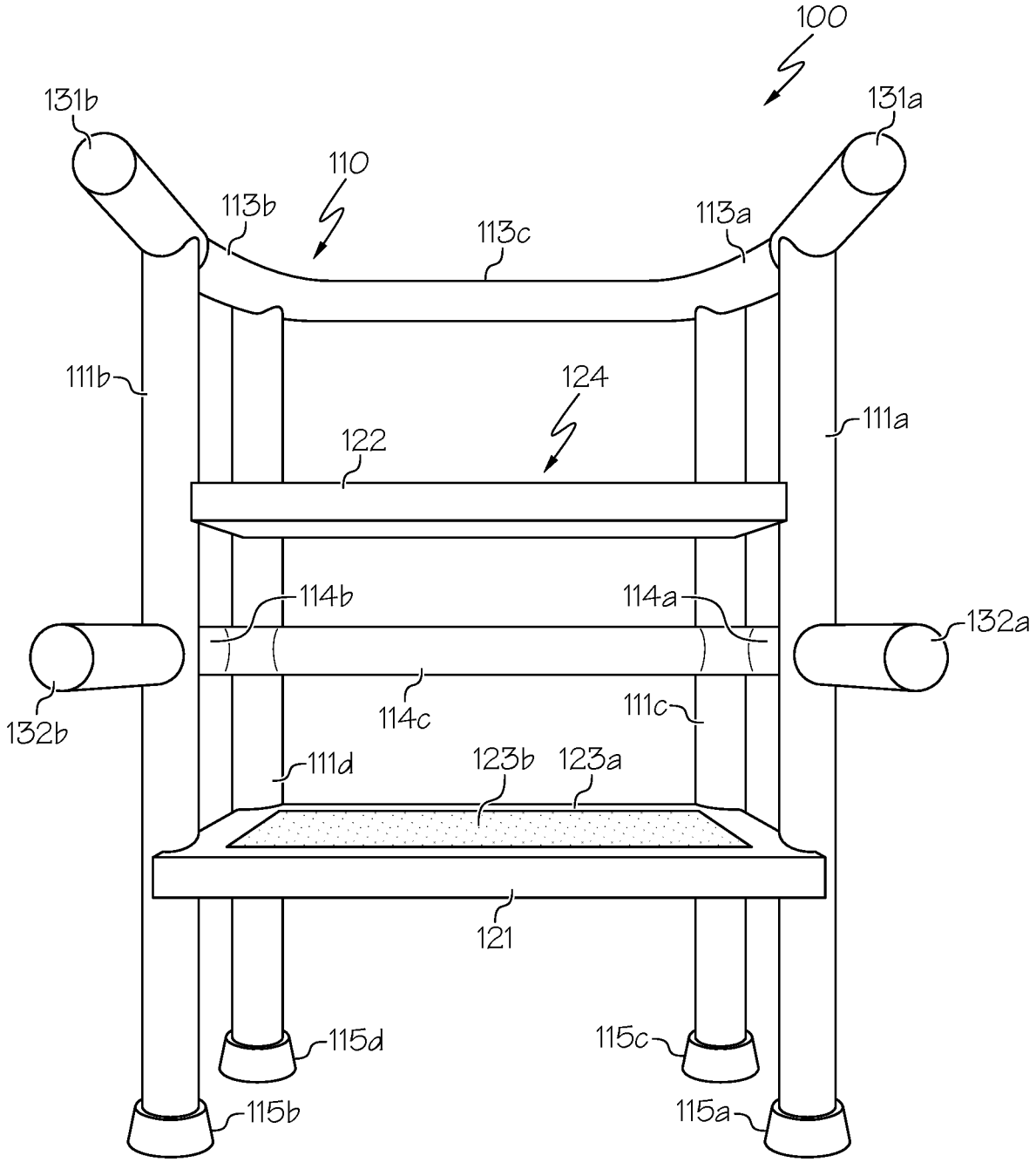
FIG. 1B depicts a front perspective view of the shoe tie-assisting device according to FIG. 1A.
Figure 1C:
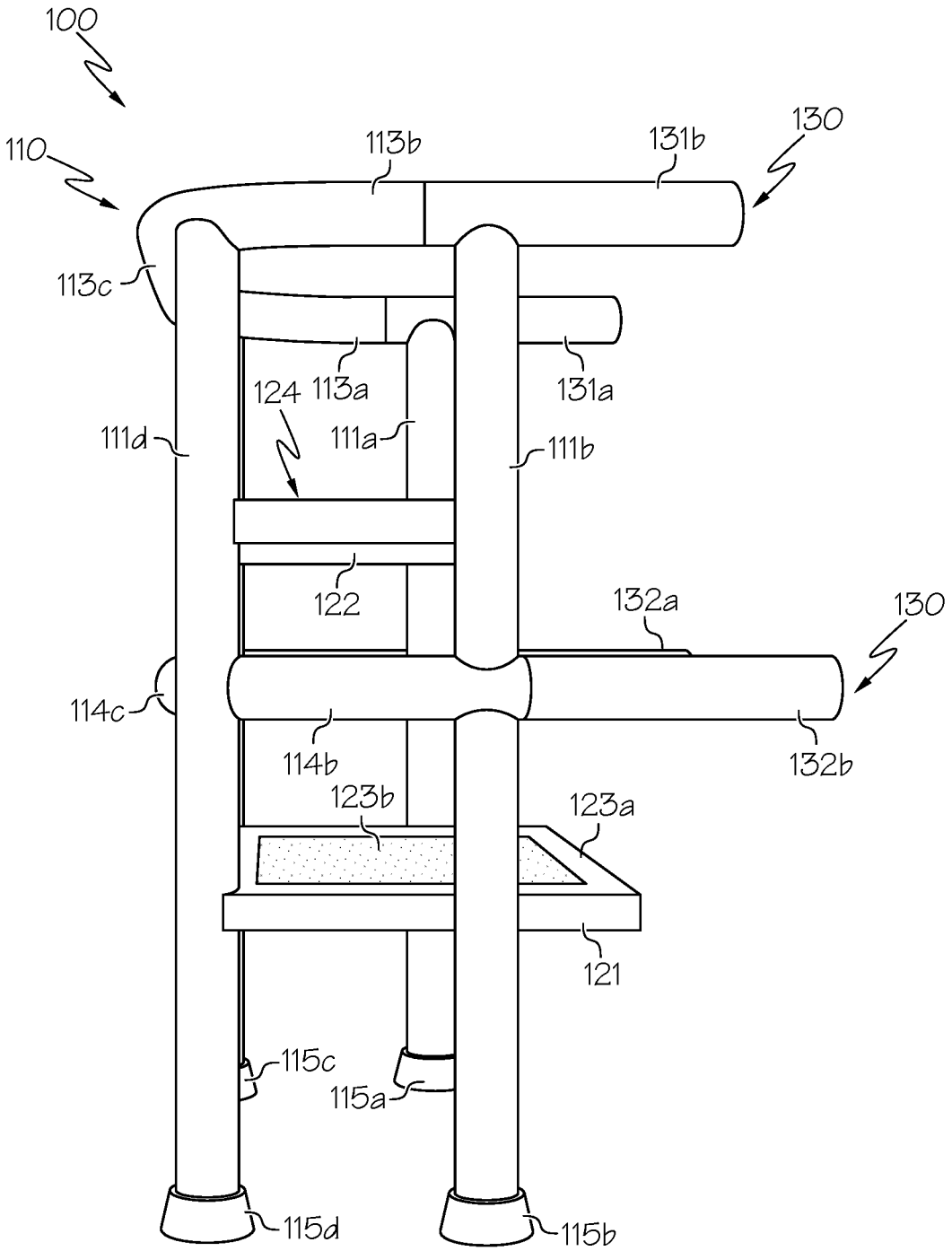
FIG. 1C depicts a side perspective view of the shoe tie-assisting device according to FIG. 1A.

Referring to FIGS. 1A-1C, a shoe tie-assisting device 100 according to a first embodiment has a frame assembly 110 that includes four vertically-extending support columns 111 spaced to create a quadrilateral-shaped area therebetween.

A foot-resting platform assembly 120 is positioned between the support columns 111 and includes a first platform base 121 and a second platform base 122. The first platform base 121 has a generally rectangular shape that is connected to all four support columns 111, extending in a generally horizontal direction. The front of the first platform base 121 extends past the front support columns 111*a*, 111*b*. In alternative embodiments, the first platform base 121 can connect to fewer than all of the support columns 111, such as only the back support columns 111*c*, 111*d*. The first platform base 121 includes a first platform surface 123*a*, which is partially covered in an anti-slip material 123*b*. Similarly, the second platform base 122 has a rectangular shape that is connected to all four support columns 111, extending in a generally horizontal direction. The front of the second platform base does not extend as far horizontally as the first platform base 121 (see FIG. 1C). The second platform base 122 includes a second platform surface 124*a* also partially covered in an anti-slip material 124*b*. The second platform surface 124*a* is configured in a stepped relationship with the first platform surface 123.

As depicted, the platform bases 121, 122 are fixed to the support columns 111. However, in alternative embodiments, the platform bases 121, 122 can be configured to height adjustable. For example, the platform bases 121, 122 may be attached to the support columns 111 via adjustable securing means. The platform bases 121, 122 can be configured to be manually adjusted. Alternatively, the shoe tie-assisting device 100 can include electronic components that allow the platform bases 121, 122 to be adjusted.

The frame assembly 110 also includes horizontally-extending upper support bars 113, which serve to connect the upper ends of the support frames 111. Specifically, the front right support column 111*a* is connected to the back right support column 111*c* with right upper support bar 113*a*; the front left support column 111*b* is connected to the back left support column 111*d* with left upper support bar 113*b*; and the back right support column 111*c* is connected to the back left support column 111*d* with back upper support bar 113*c*. The front right support column 111*a* is not directly connected to the front left support column 111*b* with an upper support bar 113 such that the area between the support columns 111 is open from the front direction. As depicted, the upper support bars 113 are all segments of a single piece bent to form the respective support bars 113*a*, 113*b*, 113*c*. Thus, the transitions between the right upper support bar 113*a* and the back upper support bar 113*c* as well as the left upper support bar 113*b* and the back upper support bar 113*c* are curved. In alternative embodiments, each support bar 113*a*, 113*b*, 113*c* can be a separate piece, all optionally directly secured to one another.

Extending at an angle from the upper ends the front support columns 111*a*, 111*b* are a first pair of handles 131*a*, 131*b*. The handles 131*a*, 131*b* can be extended sections of the upper support bars 113*a*, 113*b* (as depicted), or the handles 131*a*, 131*b* can be separate pieces. If the handles 131*a*, 131*b* are separate pieces from the upper support bars 113*a*, 113*b*, they can positioned at the same or a different height along the front support columns 111*a*, 111*b*. The handles 131*a*, 131*b* can be covered with a gripping material, e.g. a rubber or foam, which allows a user to grip the handles without the risk that their hands will slip off of the handles.

The frame assembly 110 also includes horizontally-extending intermediate support bars 114, which serve to connect the support frames 111 at an intermediate height between their upper ends and lower ends. Specifically, the front right support column 111*a* is connected to the back right support column 111*c* with right intermediate support bar 114*a*; the front left support column 111*b* is connected to the back left support column 111*d* with left intermediate support bar 114*b*; and the back right support column 111*c* is connected to the back left support column 111*d* with back intermediate support bar 114*c*. Again, the front right support column 111*a* is not directly connected to the front left support column 111*b* with an intermediate support bar 114 such that the area between the support columns 111 is open from the front direction. As depicted, the intermediate support bars 114 are all segments of a single piece bent to form the respective support bars 114*a*, 114*b*, 114*c*. Thus, the transitions between the right intermediate support bar 114*a* and the back intermediate support bar 114*c* as well as the left intermediate support bar 114*b* and the back intermediate support bar 114*c* are curved. In alternative embodiments, each support bar 114*a*, 114*b*, 114*c* can be a separate piece, all optionally directly secured to one another.

Extending at an angle from the intermediate height of the front support columns 111*a*, 111*b* are a second pair of handles 132*a*, 132*b*. The handles 132*a*, 132*b* can be extended sections of the intermediate support bars 114*a*, 114*b*, or the handles 132*a*, 132*b* can be separate pieces. The handles 132*a*, 132*b* can be covered with a gripping material, e.g. a rubber or foam, which allows a user to grip the handles without the risk that their hands will slip off of the handles. Together the first pair of handles 131 and second pair of handles 132 constitute a handle assembly 130. The highest vertical handle(s) of the handle assembly 130, the first pair of handles 131 as depicted, are preferably at a height that can be reached by persons within a typical height range (e.g. 4'6" to 6'6") without requiring them to bend over. For example, the first pair of handles 131 are preferably at height of at least 24 inches, more preferably at least 30 inches, and most preferably at least 36 inches. In this regard, as described in more detail below, the person can grasp a portion of the device without bending over.

As depicted, the handles 131, 132 are fixed in their locations. However, in alternative embodiments, either or both pairs of handles 131, 132 could be height adjustable such that a user could customize their location. For example, the handles 131, 132 may be attached to the support columns 111 via adjustable securing means. Alternatively, the support columns 111 themselves may be height adjustable. For example, each support column 111 may be configured as a pair of telescoping columns such that the upper portion of the column connected to the handles 131, 132 may be raised or lowered to a desired height. The height of the handles 131, 132 can be configured to be manually adjusted. Alternatively, the shoe tie-assisting device 100 can include electronic components that allow the handles 131, 132 to be adjusted.

At the base of the bottom ends of the support columns 111 are base portions 115. These base portions 115 are preferably made of a non-slip material, e.g. a rubber, which can engage several floor surface types with a high degree of friction such that the shoe tie-assisting device 100 does not slide along the floor during use. As depicted, the base portions 115*a*, 115*b*, 115*c*, 115*d* are end-caps covering the bottom ends of the support columns 111*a*, 111*b*, 111*c*, 111*d*. However, other types of base portions are contemplated.

In alternative embodiments, the frame 110 need not include all of the upper support bars 113 and the intermediate support bars 114. Specifically, it is preferred that the front right support column 111*a* is connected with the back right support column 111*c* at at least two different heights, the back right support column 111*c* is connected with the back left support column 111*d* at at least two different heights, and the front left support column 111*b* is connected with the back left support column 111*d* at at least two different heights. This can be achieved with a variety of combinations of the upper support bars 113 and the intermediate support bars 114. Additionally, the platform bases 121, 122 can constitute a connection between adjacent support columns 111.

The components of the first shoe tie-assisting device 100 can be made from various materials provided they provide adequate structural support for supporting the body weight of a user without the device 100 tipping. In one example, the support columns 111, the upper support bars 113, the intermediate support bars 114, platform bases 121, 122, and handles 131, 132 can be made of a metal material such as stainless steel. These components can be made via various processes, i.e. die-casting. These components can be connected together in various ways, such as by welding or via fasteners, such as screws, bolts, etc. In alternative embodiments, the platform bases 121, 122 can be made of a plastic material.

In one example method of utilizing the shoe tie-assisting device 100, from a standing position without bending over, a user first grips the first pair of handles 131*a*, 131*b* with each of their hands, respectively. The user then lifts the foot having the shoe to be tied/untied onto the platform assembly 120. The user can lift the foot to the first platform surface 124 and thereafter the second platform surface 125 if desired. The user then lowers their upper body toward the platform assembly 120, which can include moving a first of their hands from the one of the first pair of handles 131*a*, 131*b* to one of the second pair of handles 132*a*, 132*b*, and thereafter moves their second hand from the other handle 131*a*, 131*b* to the other handle 132*a*, 132*b*. From this position, the user can reach the shoe on the platform assembly 120 with his/her hands so that it can be tied/untied. Once the tying/untying is complete, the user can return to a fully upright position be reversing the order in which he lowered himself.

It is contemplated that the shoe tie-assisting device 100 can be about three feet wide, two feet deep, and four feet tall.

However, other dimensions are also contemplated provided they allow a user to tie their own shoes.

In alternative embodiments, the shoe tie-assisting device 100 can be configured to be collapsible to reduce the space it occupies, for example during packaging or shipping. For example, the platform assembly 120 may be configured to rotate out of the quadrilateral-shaped area defined by the support columns 111. This can be achieved by the platform bases 121, 122 being rotatably secured to the rear support columns 111*c*, 111*d*. Further, the front support columns 111*a*, 111*b* may be configured to rotate to positions nearer the rear support columns 111*c*, 111*d*. For example, with platform assembly 120 rotated out of the way, the support bars 113*a*, 114*a* can be rotatable about their connection to the rear right support column 111*c* such that the front right support column 111*a* rotates to a position nearer to the rear left support column 111*d*. Similarly, the support bars 113*b*, 114*b* can be rotatable about their connection to the rear left support column 111*dc* such that the front left support column 111*n* rotates to a position nearer to the rear right support column 111*c*. The shoe tie-assisting device 100 can be manually collapsible. Alternatively, the shoe tie-assisting device 100 can include electronic components that cause its components to collapse.

Second Embodiment

Figure 2A:
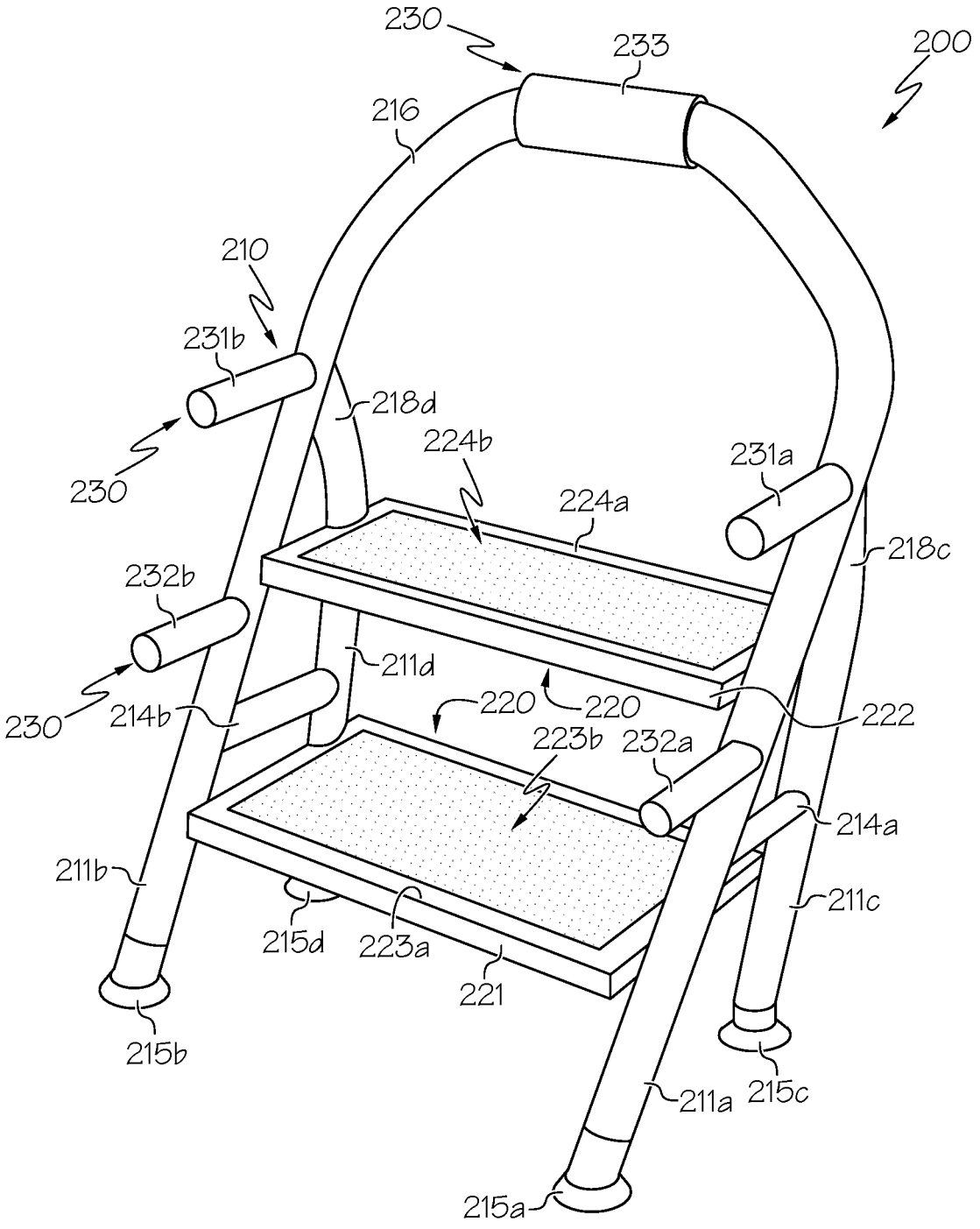
FIG. 2A depicts an isometric view of a shoe tie-assisting device according to a second embodiment.
Figure 2B:
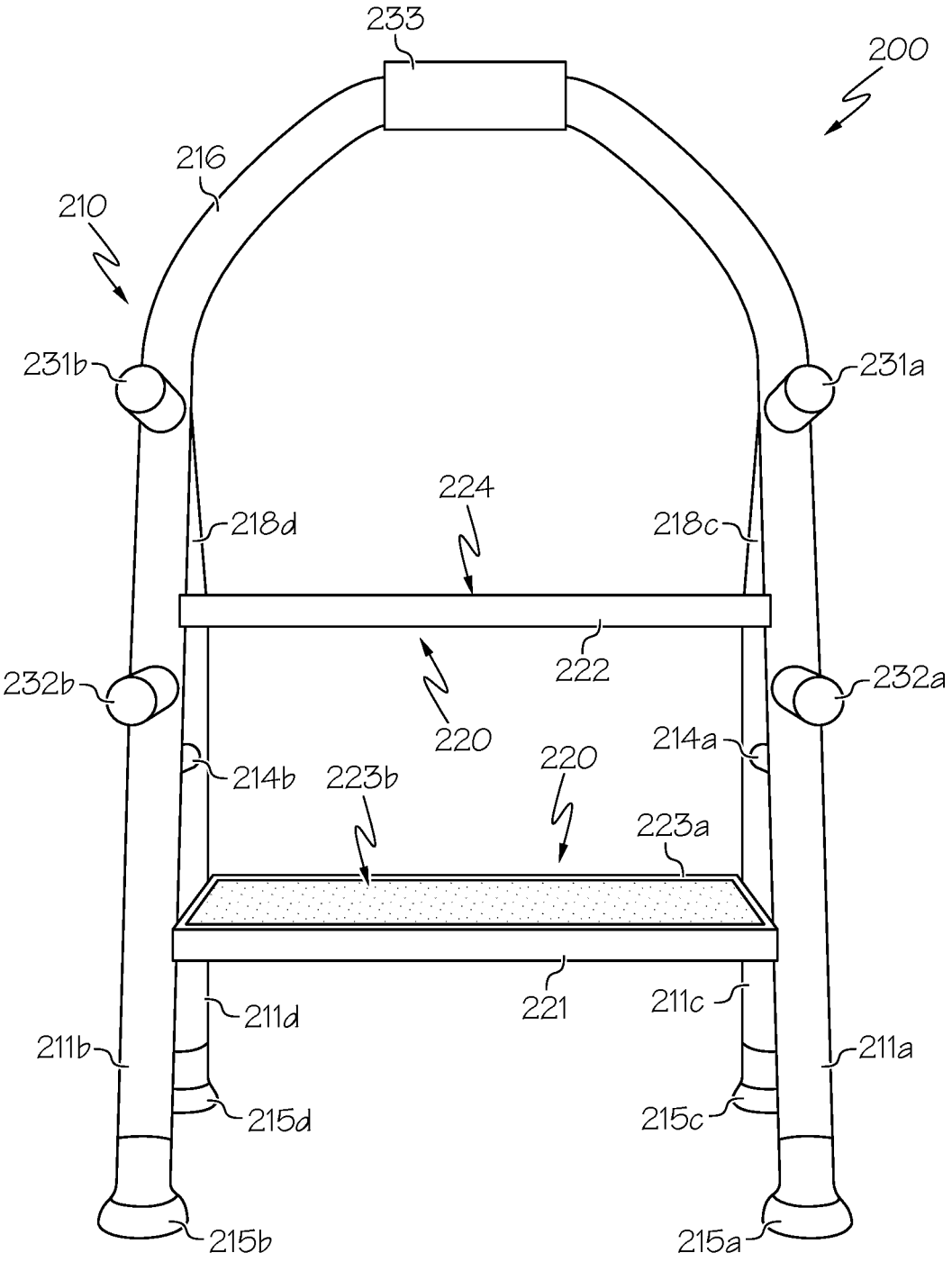
FIG. 2B depicts a front perspective view of the shoe tie-assisting device according to FIG. 2A.
Figure 2C:
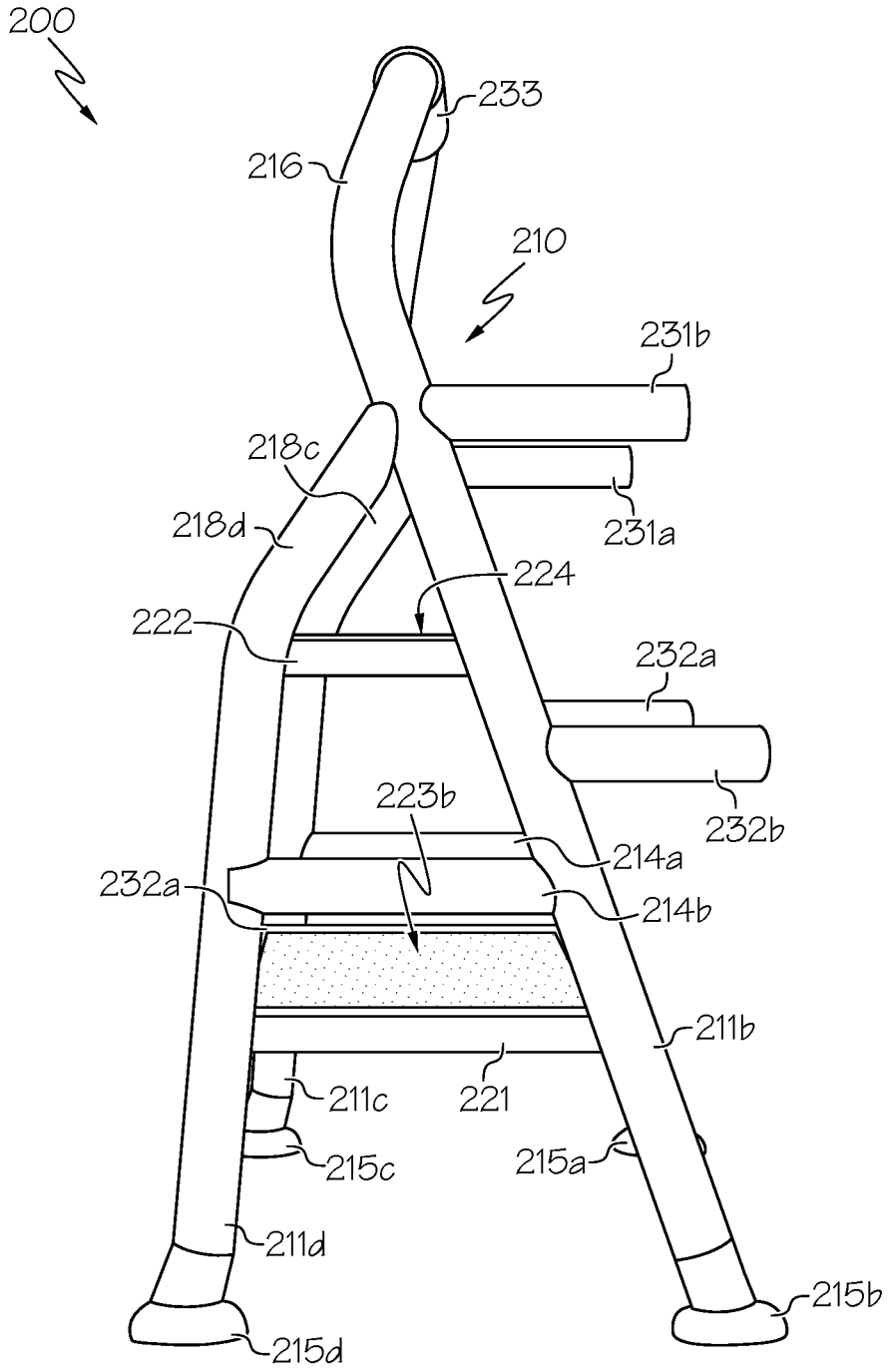
FIG. 2C depicts a side perspective view of the shoe tie-assisting device according to FIG. 2A.

Referring to FIGS. 2A-2C, a shoe tie-assisting device 200 according to a second embodiment is similar has a frame assembly 210 that includes four support columns 211 that are spaced and their lower ends to create a rectangular space in a horizontal plane therebetween. The support front support columns 211*a*, 211*b* are angled with respect to the rear support columns 211*c*, 211*d* such that the distance between them gradually decreases in the upward direction (see FIG. 2C). The upper ends of the rear support columns 211*c*, 211*d* include bent sections 218*c*, 218*d* which are bent towards the front support columns 211*a*, 211*b*. The bent sections 218*c*, 218*d* are angled to hasten the gradual decrease in distance between as well as connect the rear support columns 211*c*, 211*d* and front support columns 211*a*, 211*b*.

A foot-resting platform assembly 220 is positioned between the support columns 211 and includes a first platform base 221 and a second platform base 222. The first platform base 221 has a generally rectangular shape that is connected at its corners to all four support columns 211, extending in a generally horizontal direction. In alternative embodiments, the first platform base 221 can extend outside of the area between the support columns 211, such as past the front support columns 211*a*, 211*b*. The first platform base 221 includes a first platform surface 223*a* partially covered in an anti-slip material 223*b*. Similarly, the second platform base 222 has a rectangular shape that is connected at its corners to all four support columns 211, extending in a generally horizontal direction. Because the distance between the front support columns 211*a*, 211*b* and rear support columns 211*c*, 211*d* decrease in the upwards direction, the front of the second platform base 222 does not extend as far horizontally as the first platform base 221 (see FIG. 2C). The second platform base 222 includes a second platform surface 224*a* also partially covered in an anti-slip material 224*b*. The second platform surface 224*a* is configured in a stepped relationship with the first platform surface 223*a*.

The frame assembly 210 also includes an upwardly-extending, curved upper support bar 216 extending from the upper ends of and connecting the front support frames 211*a*, 211*b*. The central portion of the upper support bar 216 is covered with a gripping material, e.g. a rubber or foam, to create a handle section 233. The gripping material allows a user to grip the handles without the risk that their hands will slip off of the handle section 233. In alternative embodiments, the upper support bar 216 can be formed of straight segments connected to one another to form a generally curved shape.

Extending at an angle from the upper ends the front support columns 211*a*, 211*b* are a first pair of handles 231*a*, 231*b*. As depicted, the handles 231*a*, 231*b* are covered with a gripping material, e.g. a rubber or foam, which allows a user to grip the handles without the risk that their hands will slip off of the handles 231.

The frame assembly 210 also includes horizontally-extending intermediate support bars 214 which connect the support columns 211 at an intermediate height between their upper ends and lower ends. A right intermediate support bar 214*a* extends from the front right support column 211*a* to the back right support column 211*c*, and a left intermediate support bar 214*b* extends from the front left support column 211*c* to the back left support column 211*d*. An intermediate support bar 214 does not extend between the front right support column 211*a* and the front left support column 211*b* such that the rectangular area between the support columns 211 is open from the front direction. Additionally, as depicted, an intermediate support bar 214 does not extend between the back right support column 211*c* and the back left support column 211*d*. However, in alternative embodiments, an intermediate support bar 214 can extend between these columns 211*c*, 211*d* for additional stability.

Figure 2D:
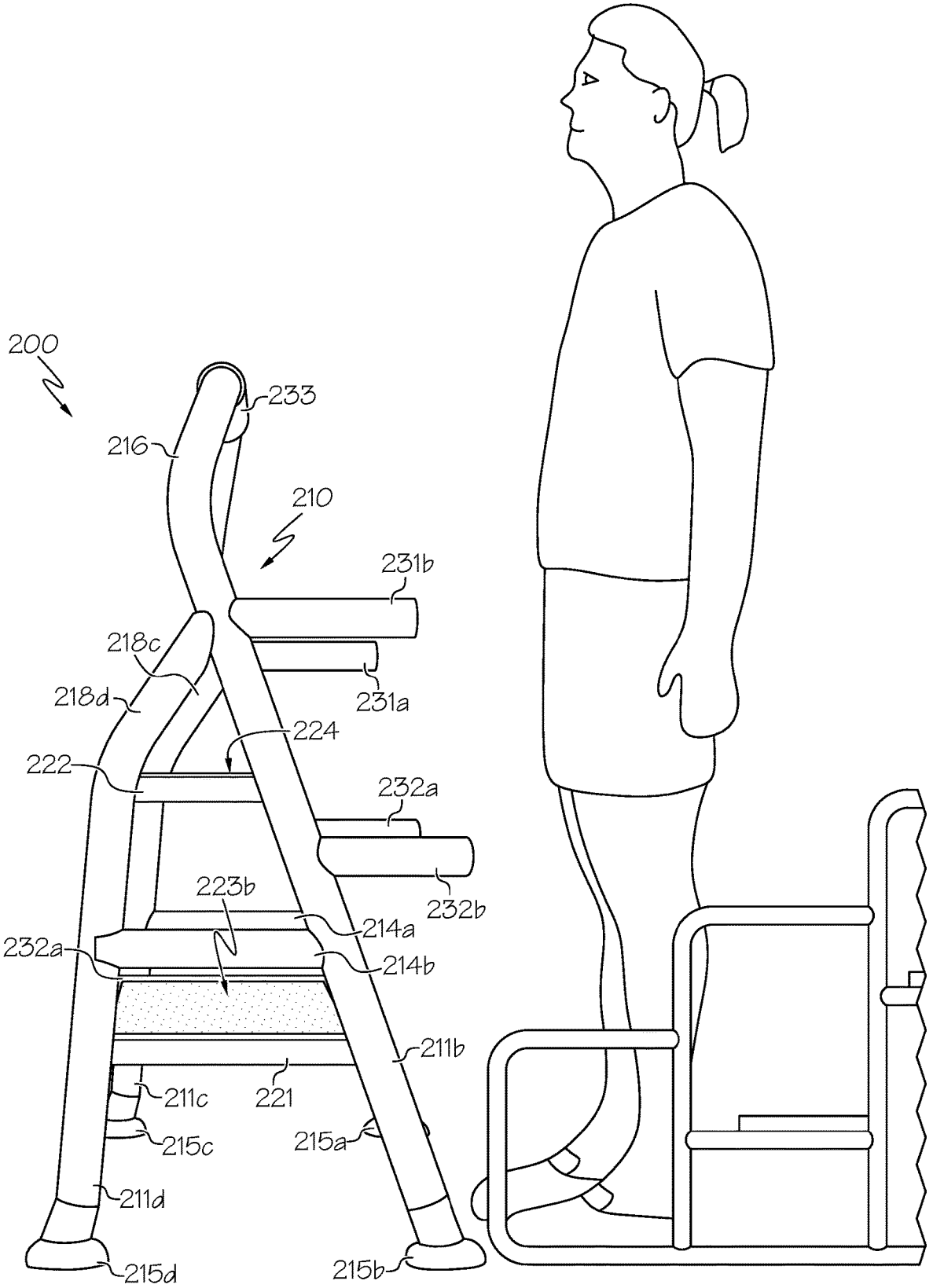
FIG. 2D depicts a side perspective view of the shoe tie-assisting device according to FIG. 2A next to a person and a prior art device for height comparison.

Extending at an angle from an intermediate height of the front support columns 211*a*, 211*b* are a second pair of handles 232*a*, 232*b*. As depicted, the handles 232*a*, 232*b* are covered with a gripping material, e.g. a rubber or foam, which allows a user to grip the handles without the risk that their hands will slip off of the handles 232. Also as depicted, the second pair of handles 232*a*, 232*b* are at the same height as the intermediate support bars 214. However, in alternative embodiments, the second pair of handles 232*a*, 232*b* can extend at a different height than the intermediate support bars 214. Together, the first pair of handles 231, second pair of handles 232, and handle section 233 of the upper support bar 216 constitute a handle assembly 230. The highest vertical handle(s) of the handle assembly 230, the handle section 233 as depicted, are preferably at a height that can be reached by persons within a typical height range (e.g. 4'6" to 6'6") without requiring them to bend over. For example, the handle section 233 is preferably at height of at least 24 inches, more preferably at least 30 inches, and most preferably at least 36 inches. In this regard, as described in more detail below, the person can grasp a portion of the device without bending over. FIG. 2D depicts an example of the height of the shoe-tie assisting device next to a person. It is clear that the person can reach at least the handle section 233 without bending over.

At the base of the bottom ends of the support columns 211 are base portions 215. These base portions 215 are preferably made of a material, e.g. a rubber, which can engage several floor surface types with a high degree of friction such that the shoe tie-assisting device 200 does not slide along the floor during use. As depicted, the base portions 215*a*, 215*b*, 215*c*, 215*d* are end-caps covering the bottom ends of the support columns 211*a*, 211*b*, 211*c*, 211*d*.

Like the first shoe tie-assisting device 100, the components of the second shoe tie-assisting device 200 can be made from various materials provided they provide adequate structural support for supporting the body weight of a user without the device 200 tipping. In one example, the support columns 211, the upper support bar 216, the intermediate support bar 214, platform bases 221, 222, and handles 231, 232 can be made of a metal material such as stainless steel. These components can be made via various processes, i.e. die-casting. These components can be connected together in various ways, such as by welding or via fasteners, such as screws, bolts, etc. Additionally, the platform bases 221, 222 can be made of a plastic material.

Figure 2E:
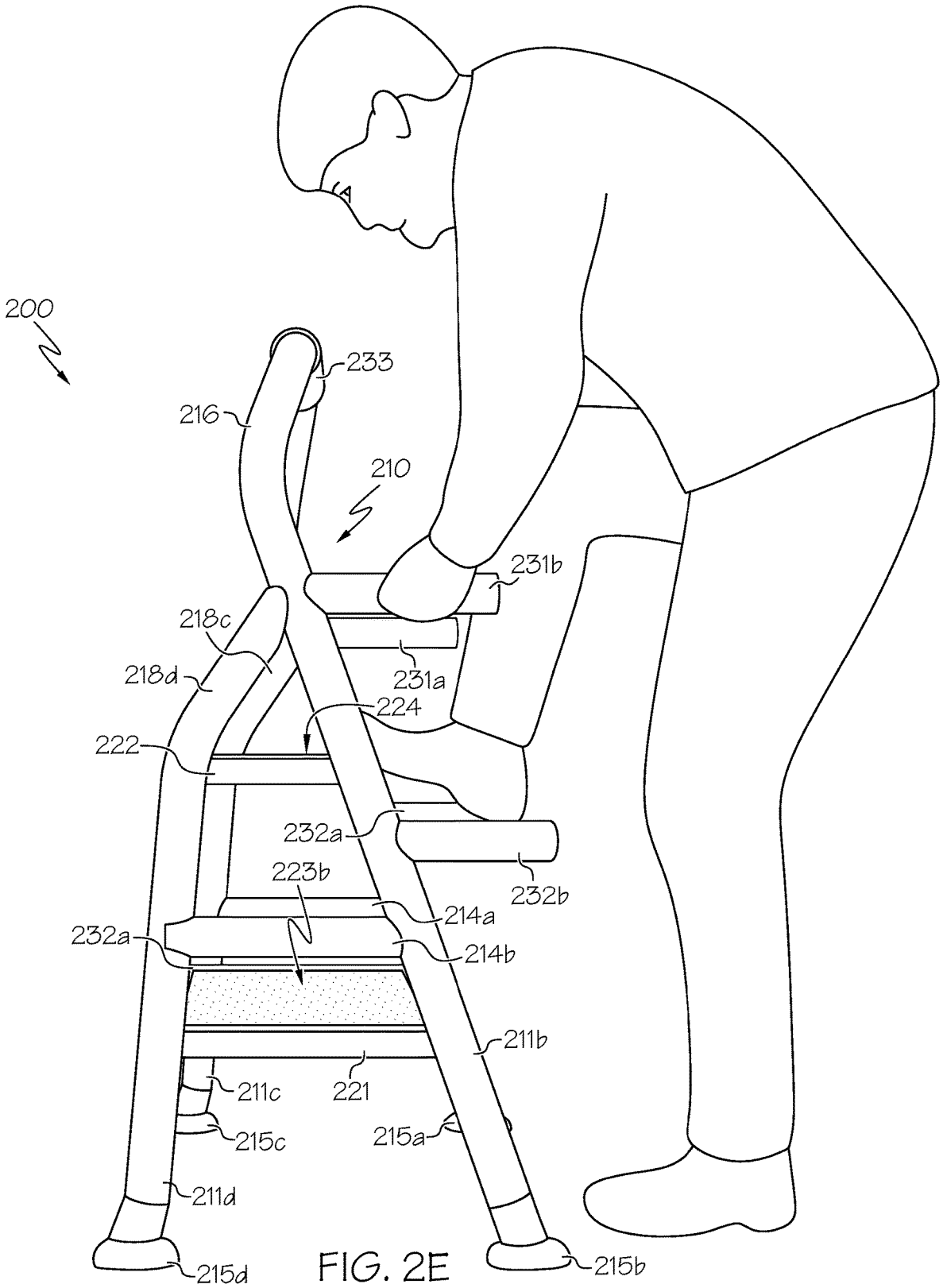
FIG. 2E depicts a side perspective view of the shoe tie-assisting device according to FIG. 2A being used by a person.

In one example method of utilizing the shoe tie-assisting device 200, from a standing position without bending over, a user first grips the handle section 233 of the upper support bar 216. The user can then lift the foot having the shoe to be tied/untied onto the platform assembly 220 and then move their hands to the first pair of handles 231*a*, 231*b*, or vice-versa (see FIG. 2E). When lifting the foot to the platform assembly 220, the user can lift the foot to the first platform surface 221 and thereafter the second platform surface 222 if desired (see FIG. 2E). The user then lowers their upper body toward the platform assembly 220, optionally by moving a first of their hands from the one of the first pair of handles 231*a*, 231*b* to one of the second pair of handles 232*a*, 232*b*, and thereafter moves their second hand from the other handle 231*a*, 231*b* to the other handle 232*a*, 232*b*. From this position, the user can reach the shoe on the platform assembly 220 with his/her hands so that it can be tied/untied. Once the tying/untying is complete, the user can return to a fully upright position be reversing the order in which he lowered himself.

Similar to the shoe tie-assisting device 100, the shoe tie-assisting device 200 can be designed to be collapsible to reduce the space it occupies. Additionally, the components of the platform assembly 220 and the handle assembly 230 can be made to be adjustable so that persons of different heights can be comfortably accommodated.

Third Embodiment

Figure 3A:
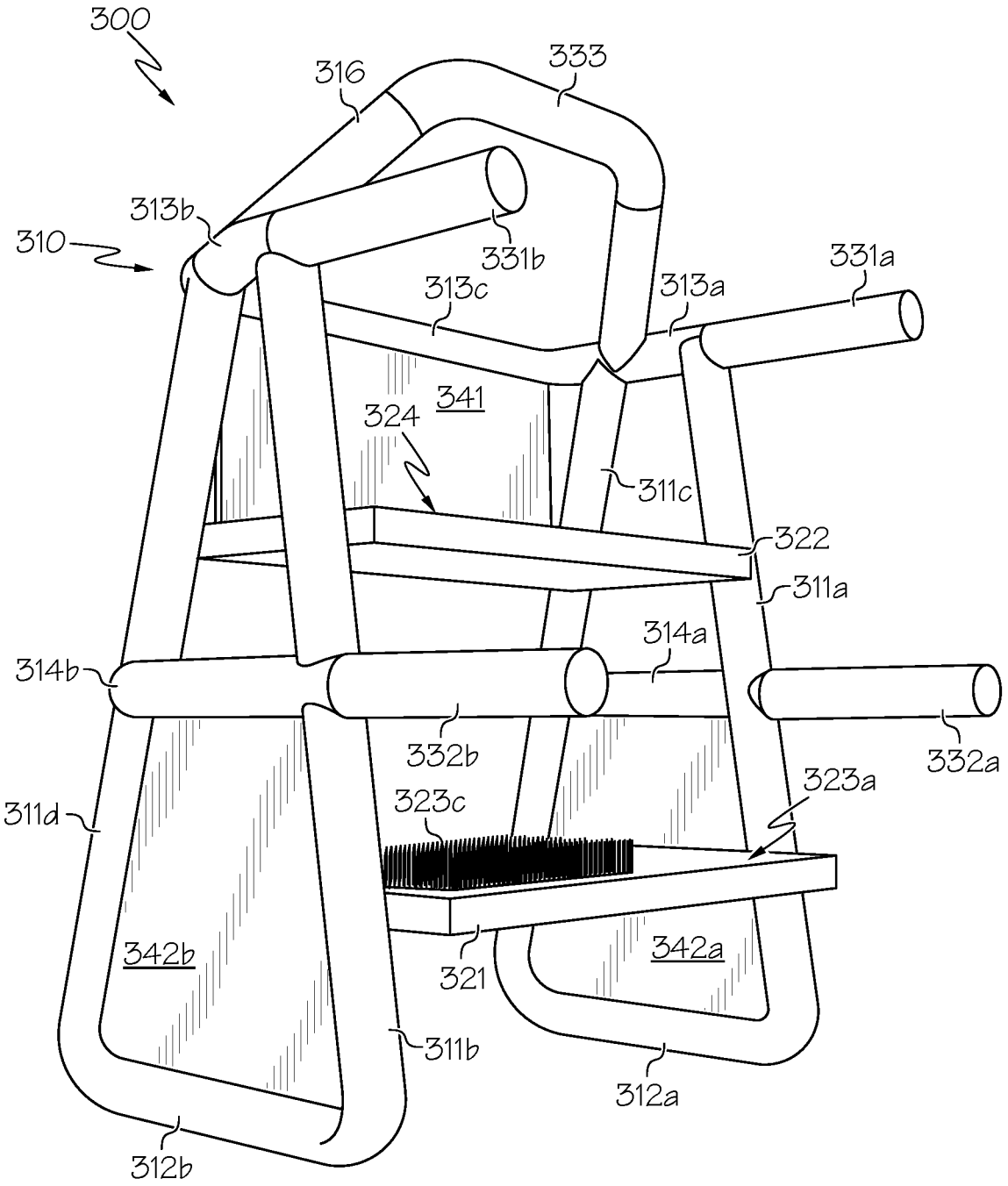
FIG. 3A depicts an isometric view of a shoe tie-assisting device according to a third embodiment.
Figure 3B:
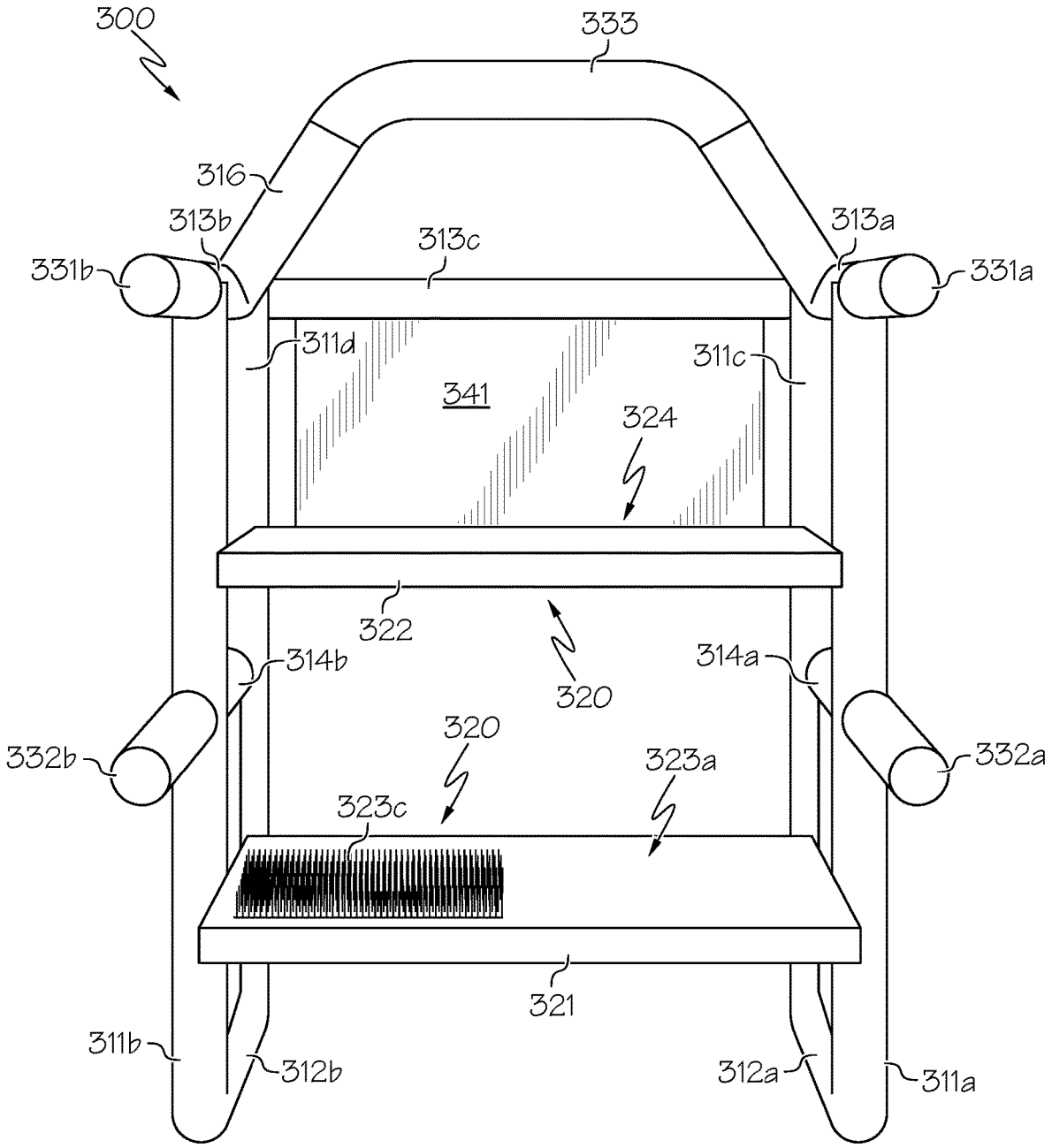
FIG. 3B depicts a front perspective view of the shoe tie-assisting device according to FIG. 3A.
Figure 3C:
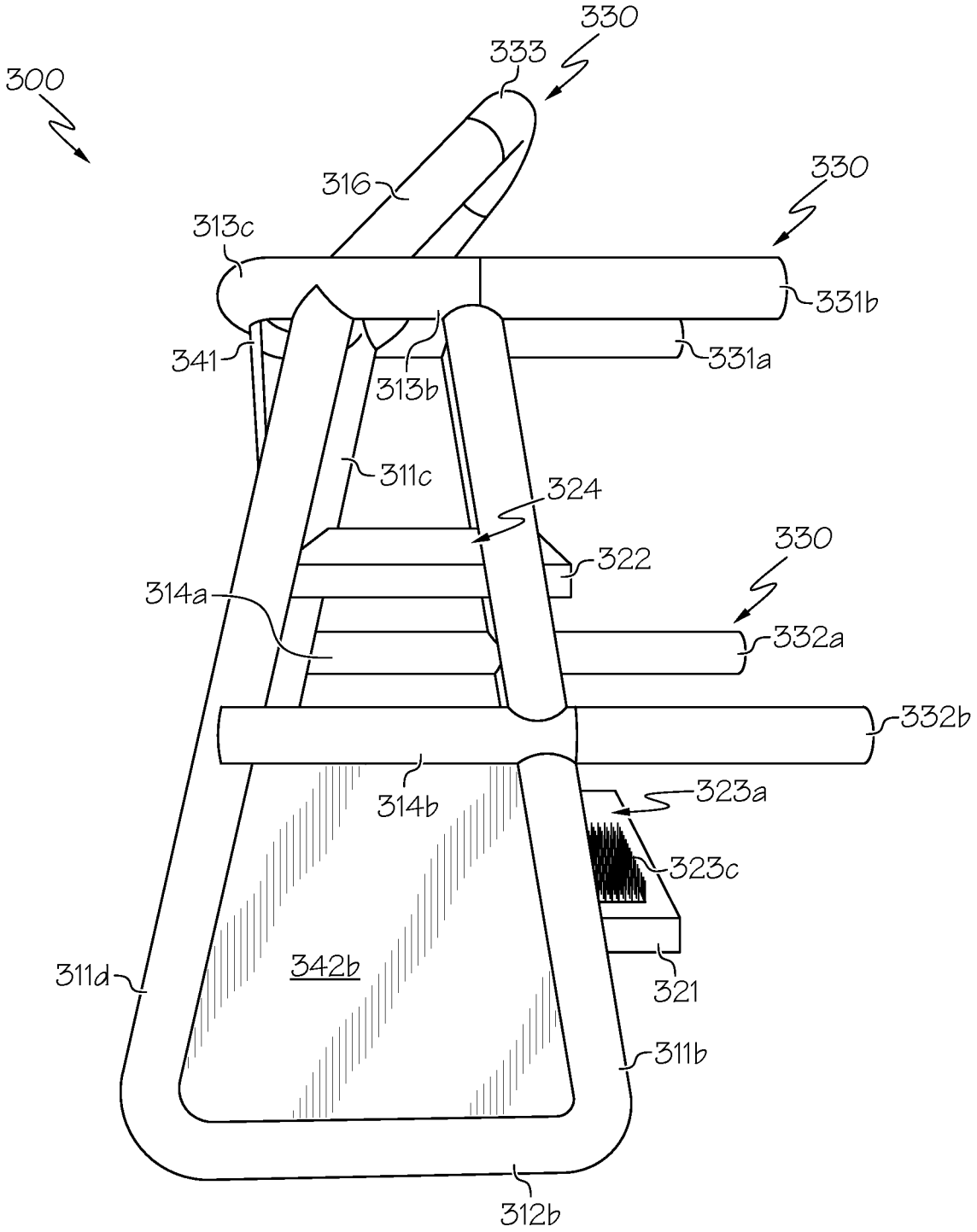
FIG. 3C depicts a side perspective view of the shoe tie-assisting device according to FIG. 3A.

Referring to FIGS. 3A-3C, a shoe tie-assisting device 300 according to a third embodiment is similar to the second embodiment described above with some modified features. The shoe tie-assisting device 300 has a frame assembly 310 that includes four support columns 311 that are spaced and their lower ends to create a rectangular space in a horizontal plane therebetween. The support front support columns 311*a*, 311*b* are angled with respect to the rear support columns 311*c*, 311*d* such that the distance between them gradually decreases in the upward direction (see FIG. 3C).

A foot-resting platform assembly 320 is positioned between the support columns 311 and includes a first platform base 321 and a second platform base 322. The first platform base 321 has a generally rectangular shape that is connected to all four support columns 311, extending in a generally horizontal direction. The first platform base 321 includes a first platform surface 323*a* partially covered in an anti-slip material 323*b* and partially covered with bristles to clean bottom surface of shoes. Similarly, the second platform base 322 has a rectangular shape that is connected to all four support columns 311, extending in a generally horizontal direction. Both the first platform base 321 and second platform base 322 extend partially past the front support columns 311*a*, 311*b* (see FIG. 3C). The second platform base 322 includes a second platform surface 324*a* also partially covered in an anti-slip material 324*b*. The second platform surface 324*a* is configured in a stepped relationship with the first platform surface 323*a*.

The frame assembly 310 also includes horizontally-extending upper support bars 313, which serve to connect the upper ends of the support frames 311. Specifically, the front right support column 311*a* is connected to the back right support column 311*c* with right upper support bar 313*a*; the front left support column 311*b* is connected to the back left support column 311*d* with left upper support bar 313*b*; and the back right support column 311*c* is connected to the back left support column 311*d* with back upper support bar 313*c*. The front right support column 311*a* is not directly connected to the front left support column 311*b* with an upper support bar 313 such that the area between the support columns 311 is open from the front direction. As depicted, the upper support bars 313 are all segments of a single piece bent to form the respective support bars 313*a*, 313*b*, 313*c*. Thus, the transitions between the right upper support bar 313*a* and the back upper support bar 313*c* as well as the left upper support bar 313*b* and the back upper support bar 313*c* are curved. In alternative embodiments, each support bar 313*a*, 313*b*, 313*c* can be a separate piece secured to one another.

Extending at an angle from the upper ends the front support columns 311*a*, 311*b* are a first pair of handles 331*a*, 331*b*. The handles 331*a*, 331*b* can be extended sections of the upper support bars 313*a*, 313*b* (as depicted), or the handles 331*a*, 331*b* can be separate pieces. As depicted, the handles 331*a*, 331*b* are covered with a gripping material, e.g. a rubber or foam, which allows a user to grip the handles without the risk that their hands will slip off of the handles.

The frame assembly 310 also includes horizontally-extending intermediate support bars 314, which serve to connect the support frames 311 at an intermediate height between their upper ends and lower ends. Specifically, the front right support column 311*a* is connected to the back right support column 311*c* with intermediate support bar 314*a*; the front left support column 311*b* is connected to the back left support column 311*d* with intermediate support bar 314*b*; and the back right support column 311*c* is connected to the back left support column 311*d* with back intermediate support bar 314*c*. The front right support column 311*a* is not directly connected to the front left support column 311*b* with an intermediate support bar 314 such that the area between the support columns 311 is open from the front direction. As depicted, the intermediate support bars 314 are all segments of a single piece bent to form the respective support bars 314*a*, 314*b*, 314*c*. Thus, the transitions between the right intermediate support bar 314*a* and the back intermediate support bar 314*c* as well as the left intermediate support bar 314*b* and the back intermediate support bar 314*c* are curved. In alternative embodiments, each support bar 314*a*, 314*b*, 314*c* can be a separate piece secured to one another.

Extending at an angle from an intermediate height of the front support columns 311*a*, 311*b* are a second pair of handles 332*a*, 332*b*. The handles 332*a*, 332*b* can be extended sections of the intermediate support bars 314*a*, 314*b* (as depicted), or the handles 332*a*, 332*b* can be separate pieces. As depicted, the handles 332*a*, 332*b* are covered with a gripping material, e.g. a rubber or foam, which allows a user to grip the handles without the risk that their hands will slip off of the handles.

The frame assembly 310 also includes an upwardly-extending, curved upper support bar 316 extending from the upper support bars 313*a*, 313*b*. The central portion of the upper support bar 316 is covered with a gripping material, e.g. a rubber or foam, to create a handle section 333. The gripping material allows a user to grip the handles without the risk that their hands will slip off of the handle section 333. Together, the first pair of handles 231, second pair of handles 232, and handle section 233 of the upper support bar 216 constitute a handle assembly 230.

The frame assembly 310 also includes lower support bars 312 connecting the lower ends of the front support columns 311*a*, 311*b* to the lower ends of the rear support columns 311*c*, 311*d*. Specifically, A right lower support bar 312*a* extends from the lower end of the front right support column 311*a* to the lower end of the back right support column 311*c*, and a left lower support bar 312*b* extends from the lower end of the front left support column 311*c* to the lower end of the back left support column 311*d*. As depicted, the front right support column 311*a*, right lower support bar 312*a*, and rear right support column 311*c*, as well as the front left support column 311*b*, left lower support bar 312*b*, and rear left support column 311*d* are segments of a single bent piece to form the respective support columns 311 and support bars 312. Thus, the transitions between these support columns and support bars 312 are curved. In alternative embodiments, each support column 311 and lower support bar 312 can be a separate piece secured to one another.

Below the lower support bars 312 can be base portions (not shown). The base portions are preferably made of a material, e.g. a rubber, which can engage several floor surface types with a high degree of friction such that the shoe tie-assisting device 300 does not slide along the floor during use.

Like the first and second shoe tie-assisting devices 100, 200, the components of the third shoe tie-assisting device 300 can be made from various materials provided they provide adequate structural support for supporting the body weight of a user without the device 300 tipping. In one example, the support columns 311, the lower support bars 312, the upper support bars 313, the intermediate support bars 314, the platform bases 321, 322, and the handles 331, 332 can be made of a metal material such as stainless steel. These components can be made via various processes, i.e. die-casting. These components can be connected together in various ways, such as by welding or via fasteners, such as screws, bolts, etc. Additionally, the platform bases 323, 324 can be made of a plastic material.

In one example method of utilizing the shoe tie-assisting device 300, from a standing position without bending over, a user first grips the handle section 333 of the upper support bar 316. The user can then lift the foot having the shoe to be tied/untied onto the platform assembly 320 and then move their hands to the first pair of handles 331*a*, 331*b*, or vice-versa. When lifting the foot to the platform assembly 320, the user can lift the foot to the first platform surface 321 and thereafter the second platform surface 322 if desired. The user then lowers their upper body toward the platform assembly 320, optionally by moving a first of their hands from the one of the first pair of handles 331*a*, 331*b* to one of the second pair of handles 332*a*, 332*b*, and thereafter moves their second hand from the other handle 331*a*, 331*b* to the other handle 332*a*, 332*b*. From this position, the user can reach the shoe on the platform assembly 320 with his/her hands so that it can be tied/untied. Once the tying/untying is complete, the user can return to a fully upright position be reversing the order in which he lowered himself.

Similar to the shoe tie-assisting devices discussed above, the shoe tie-assisting device 300 can be designed to be collapsible to reduce the space it occupies. Additionally, the components of the platform assembly 320 and the handle assembly 330 can be made to be adjustable so that persons of different heights can be comfortably accommodated.

Fourth Embodiment

Figure 4:
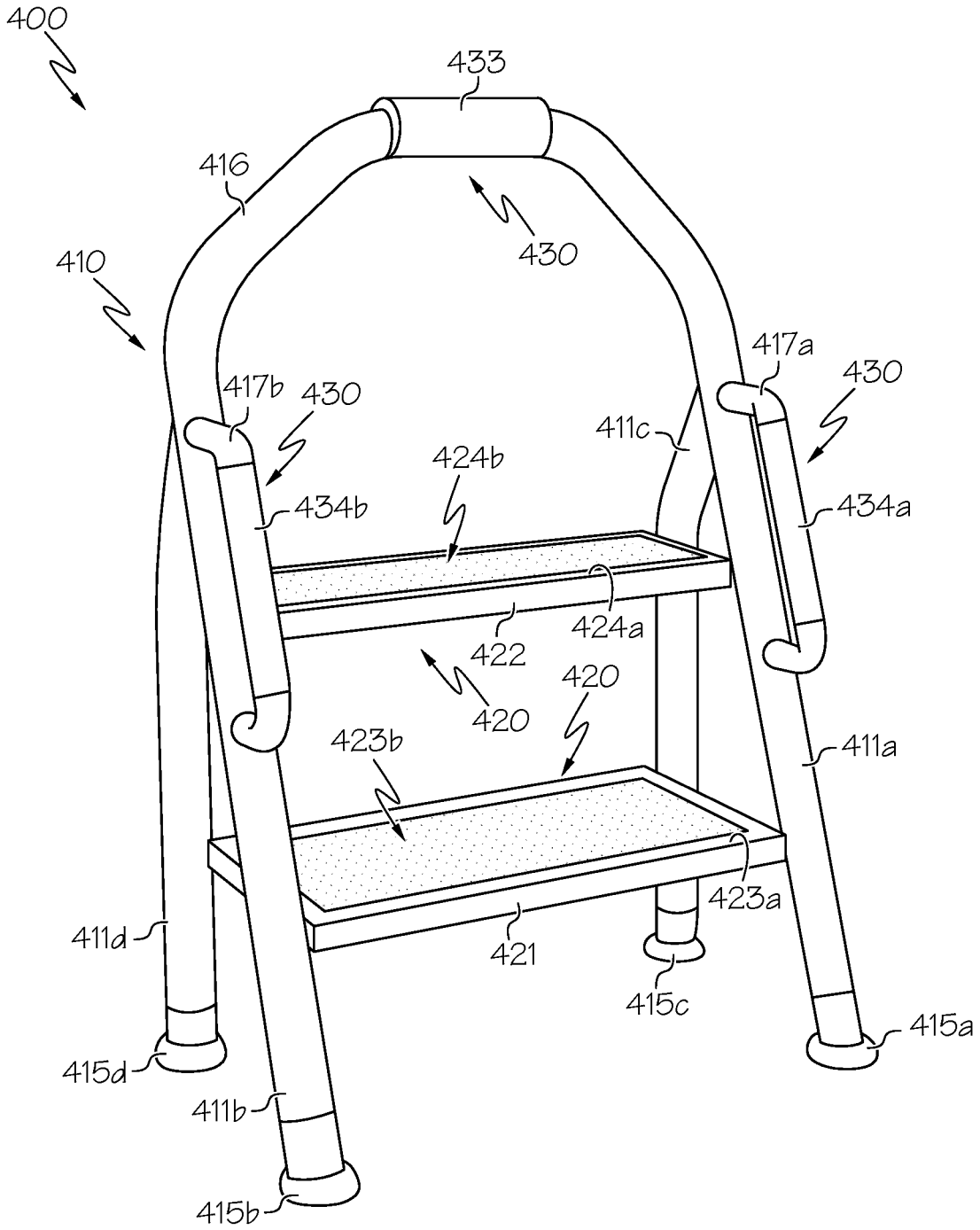
FIG. 4 depicts an isometric view of a shoe tie-assisting device according to a fourth embodiment.

Referring to FIG. 4, a shoe tie-assisting device 400 according to a fourth embodiment is similar to the second embodiment described above with some modified features. Like the second embodiment, the shoe tie-assisting device 400 according to the fourth embodiment includes a frame assembly 410 that includes support columns 411 and an upper support bar 416; a platform assembly 420 that includes platform bases 421, 422 having platform surfaces 423*a*, 424*a* both partially covered with an anti-slip material 423*b*, 424*b*; and a handle assembly 430 including a handle section 433 of the upper support bar 416. However, the shoe tie-assisting device 400 does not have handles similar to the first and second pair of handles 231, 232. Instead, the frame assembly 410 includes handle supports 417*a*, 417*b* extending from the front support columns 411*a*, 411*b*. The handle supports 417*a*, 417*b* are U-shaped with their ends connected and their middle portions generally parallel to the front support columns 411*a*, 411*b*. The middle portions of the handle supports 417*a*, 417*b* are covered with a gripping material, e.g. a rubber or foam, to form handle sections 434*a*, 434*b*.

Similar to the shoe tie-assisting devices discussed above, the shoe tie-assisting device 400 can be designed to be collapsible to reduce the space it occupies. Additionally, the components of the platform assembly 420 and the handle assembly 430 can be made to be adjustable so that persons of different heights can be comfortably accommodated.

Fifth Embodiment

Figure 5:
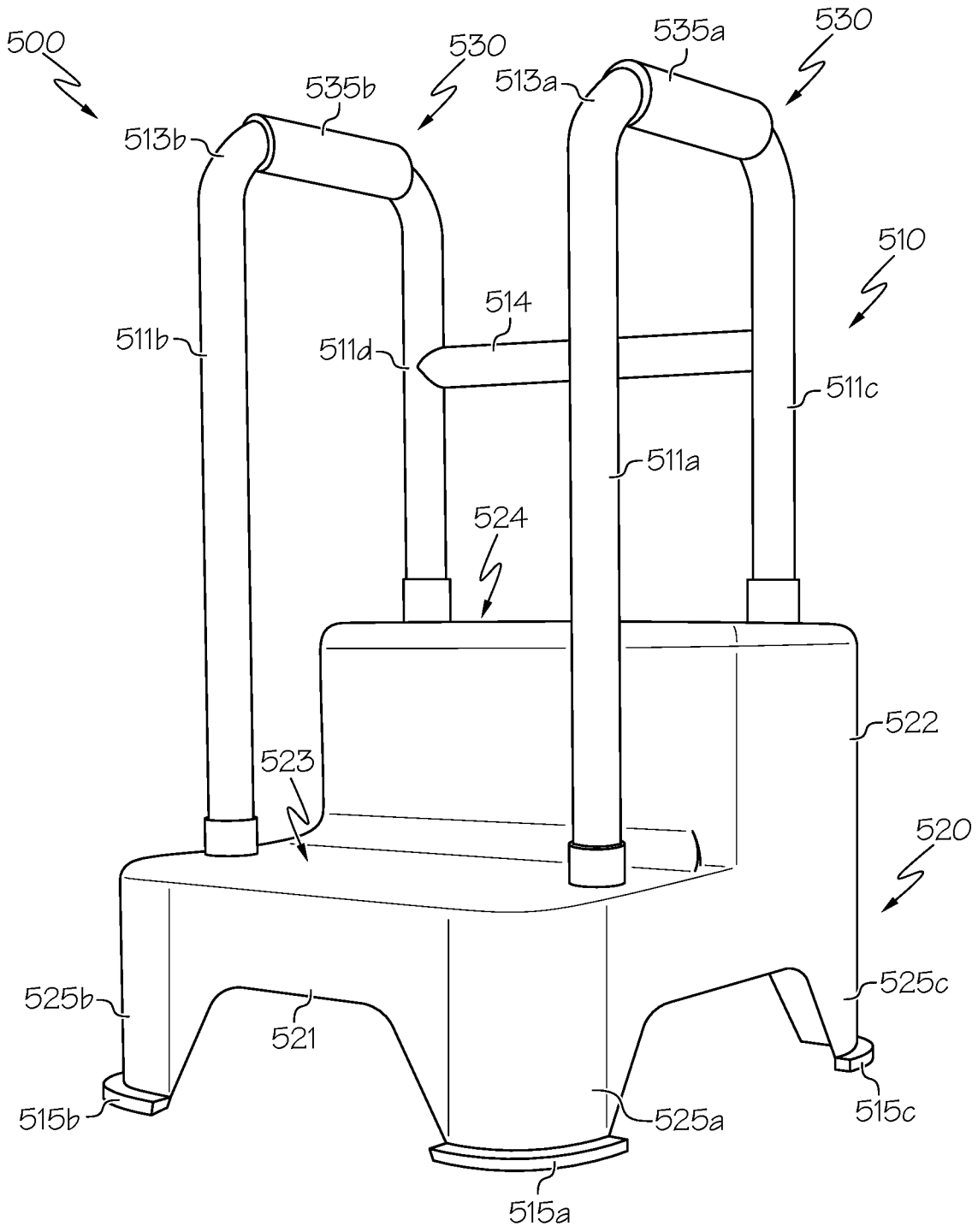
FIG. 5 depicts an isometric view of a shoe tie-assisting device according to a fifth embodiment.

Referring to FIG. 5, a shoe tie-assisting device 500 according to a fifth embodiment has a frame assembly that includes four vertically-extending support columns 511 to create a quadrilateral-shaped space therebetween.

The support columns 511 extend vertically upwards from a foot-resting platform assembly 520 in the form of a platform base that includes a first, lower base section 521 and a second, upper base section 522. The front support columns 511*a*, 511*b* extend from first base section 521 and the rear support columns 511*c*, 511*d* extend from the second base section 522. The platform base 521, 522 can be made of a plastic material and resembles a set of stairs and the first base section 521 includes a first platform surface 523. The second base section 522 is disposed above the rear portion of the first base section 521 behind the first platform surface 524, and includes a second platform surface 524. The platform surface 523, 524 can optionally be partially covered in an anti-slip material. The platform assembly 520 includes four downwardly-extending legs 525, which extend from the lower side of the first base section 521. The legs 525 each include a base portion 515 which engage a floor surface. The base portions 515 can be made of or include a material, e.g. a rubber, which can engage several floor surface types with a high degree of friction such that the shoe tie-assisting device 500 does not slide along the floor during use.

The frame assembly 510 also includes horizontally-extending upper support bars 113, which serve to connect the upper ends of the support frames 111. Specifically, the front right support column 511*a* is connected to the back right support column 511*c* with right upper support bar 513*a* and the front left support column 511*b* is connected to the back left support column 511*d* with left upper support bar 513*b*. The upper support bars 513*a*, 513*b* are each respectively covered with a gripping material, e.g. a rubber or foam, to create handle sections 535*a*, 535*b*. The gripping material allows a user to grip the handles without the risk that their hands will slip off of the handle sections 535*a*, 535*b*. The handle sections 535*a*, 535*b* together constitute a handle assembly 530.

The frame assembly 510 also includes an intermediate support bar 514 extending between the rear support columns 511*c*, 511*d* at an intermediate height thereof. The components of the frame assembly 510 can be made of a metal material such as stainless steel. These components can be made via various processes, i.e. die-casting. These components can be connected together in various ways, such as by welding or via fasteners, such as screws, bolts, etc.

Similar to the shoe tie-assisting devices discussed above, the shoe tie-assisting device 500 can be designed to be collapsible to reduce the space it occupies. Additionally, the components of the platform assembly 520 and the handle assembly 530 can be made to be adjustable so that persons of different heights can be comfortably accommodated.

Sixth Embodiment

Figure 6:
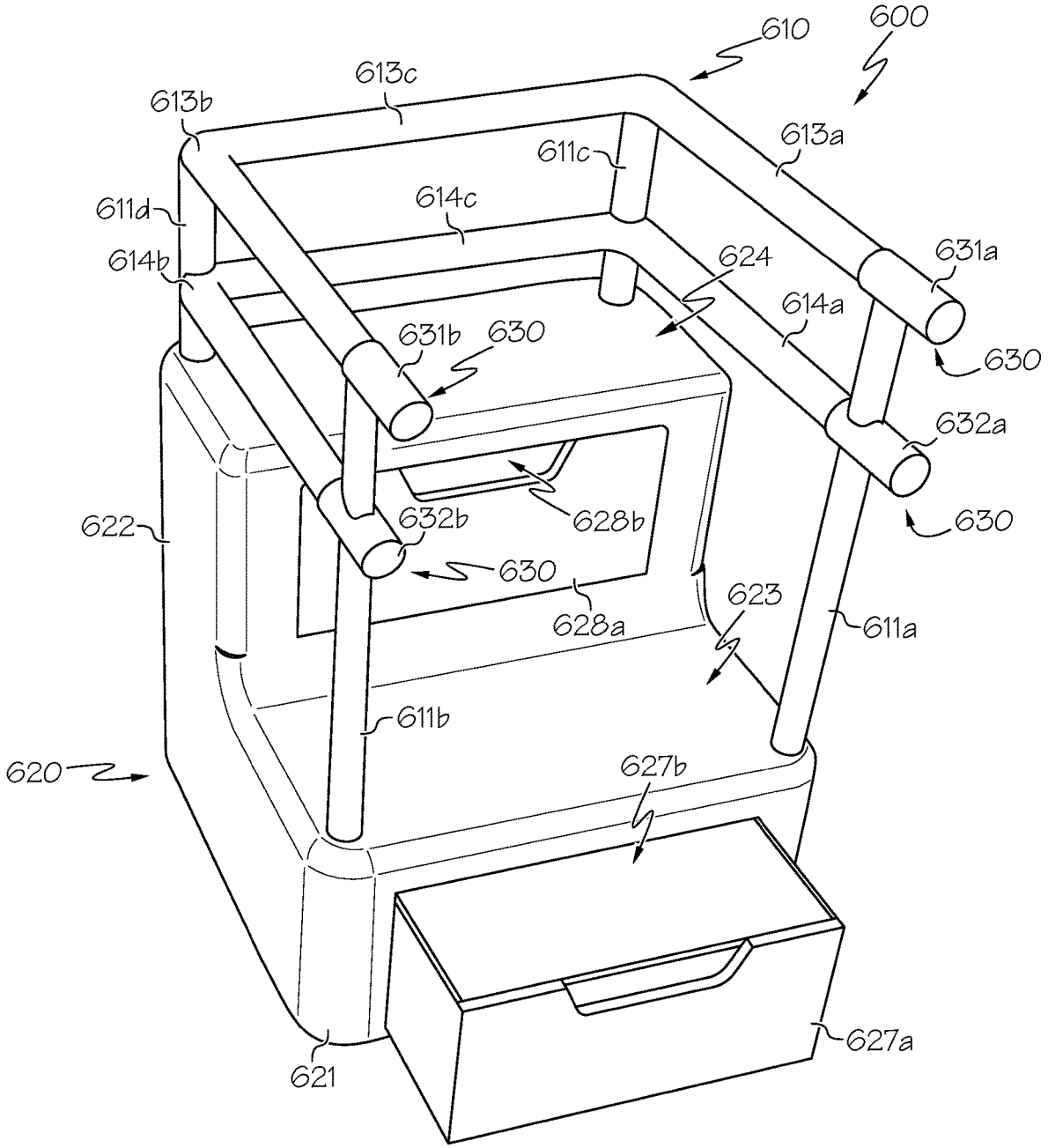
FIG. 6 depicts an isometric view of a shoe tie-assisting device according to a sixth embodiment.

Referring to FIG. 6, a shoe tie-assisting device 600 according to a sixth embodiment has a frame assembly that includes four vertically-extending support columns 611 to create a quadrilateral-shaped space therebetween.

The support columns 611 extend vertically upwards from a foot-resting platform assembly 620 in the form of a platform base that includes a first, lower base section 621 and a second, upper base section 622. The front support columns 611*a*, 611*b* extend from first base section 621 and the rear support columns 611*c*, 611*d* extend from the second base section 622. The platform base 621, 622 can be made of a plastic material and resembles a set of stairs and the first base section 621 includes a first platform surface 623. The second base section 622 is disposed above the rear portion of the first base section 621 behind the first platform surface 624, and includes a second platform surface 624. The platform surface 623, 624 are partially covered in an anti-slip material. The lower base section 621 includes a slidable storage drawer 627*a* defining a storage space 627*b* for storing items, such as shoes. Similarly, the upper base section 622 includes a slidable storage drawer 628*a* defining a storage space 628*b* for storing items, such as shoes. The platform base 621, 622 is designed to sit on a floor surface, and can optionally include base portions, such as strips (not shown) made of a material, e.g. a rubber, which can engage several floor surface types with a high degree of friction such that the shoe tie-assisting device 600 does not slide along the floor during use.

The frame assembly 610 also includes horizontally-extending upper support bars 613, which serve to connect the upper ends of the support frames 611. Specifically, the front right support column 611*a* is connected to the back right support column 611*c* with right upper support bar 613*a*; the front left support column 611*b* is connected to the back left support column 611*d* with left upper support bar 613*b*; and the back right support column 611*c* is connected to the back left support column 611*d* with back upper support bar 613*c*. The front right support column 611*a* is not directly connected to the front left support column 611*b* with an upper support bar 613 such that the area between the support columns 611 is open from the front direction.

Extending at an angle from the upper ends the front support columns 611*a*, 611*b* are a first pair of handles 631*a*, 631*b*. The handles 631*a*, 631*b* can be extended sections of the upper support bars 613*a*, 613*b* (as depicted), or the handles 631*a*, 631*b* can be separate pieces. As depicted, the handles 631*a*, 631*b* are covered with a gripping material, e.g. a rubber or foam, which allows a user to grip the handles without the risk that their hands will slip off of the handles.

The frame assembly 610 also includes horizontally-extending intermediate support bars 614, which serve to connect the support frames 611 at an intermediate height between their upper ends and lower ends. Specifically, the front right support column 611*a* is connected to the back right support column 611*c* with right intermediate support bar 614*a*; the front left support column 611*b* is connected to the back left support column 611*d* with left intermediate support bar 614*b*; and the back right support column 611*c* is connected to the back left support column 611*d* with back intermediate support bar 614*c*. Again, the front right support column 611*a* is not directly connected to the front left support column 611*b* with an intermediate support bar 614 such that the area between the support columns 611 is open from the front direction.

Extending at an angle from the intermediate height of the front support columns 611*a*, 611*b* are a second pair of handles 632*a*, 632*b*. The handles 632*a*, 632*b* can be extended sections of the intermediate support bars 614*a*, 614*b*, or the handles 632*a*, 632*b* can be separate pieces. The handles 632*a*, 132*b* can be covered with a gripping material, e.g. a rubber or foam, which allows a user to grip the handles without the risk that their hands will slip off of the handles. Together the first pair of handles 631 and second pair of handles 632 constitute a handle assembly 630.

Similar to the shoe tie-assisting devices discussed above, the shoe tie-assisting device 600 can be designed to be collapsible to reduce the space it occupies. Additionally, the components of the platform assembly 620 and the handle assembly 630 can be made to be adjustable so that persons of different heights can be comfortably accommodated.

Seventh Embodiment

Figure 7:
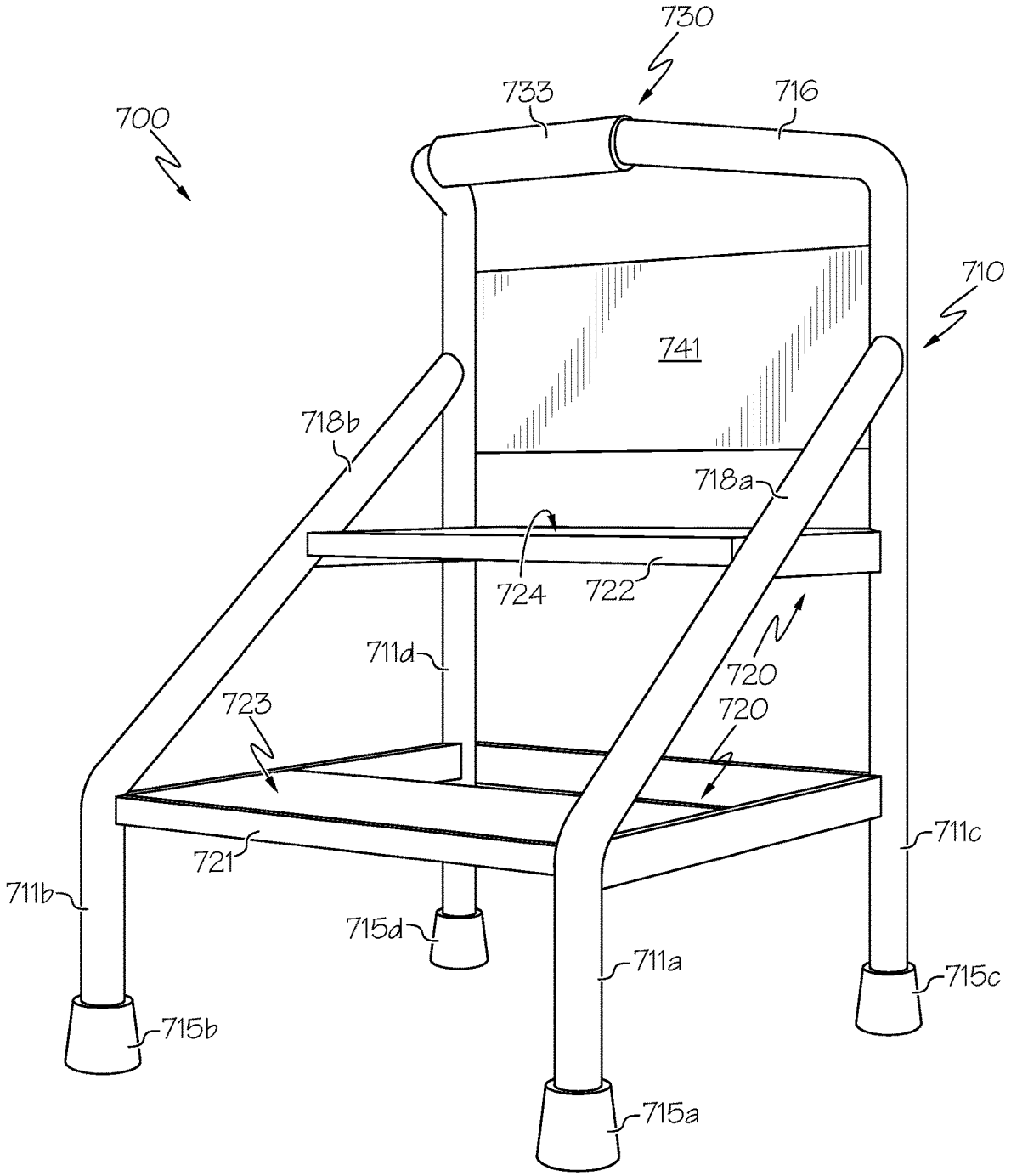
FIG. 7 depicts an isometric view of a shoe tie-assisting device according to a seventh embodiment.

Referring to FIG. 7, a shoe tie-assisting device 700 according to a sixth embodiment has a frame assembly that includes four support columns 711 to create a quadrilateral-shaped space therebetween. The rear support columns 711*c*, 711*d* are vertically-extending throughout their length, whereas the lower sections of the front support columns 711*a*, 711*b* are vertically-extending but their upper sections 718*a*, 718*b* are bent to be angled towards and connect with the rear support columns 711*c*, 711*d*.

A foot-resting platform assembly 720 is positioned between the support columns 111 and includes a first platform base 721 and a second platform base 722. The first platform base 721 has a generally rectangular shape that is connected to all four support columns 711, extending in a generally horizontal direction. The front of the first platform base 721 extends past the front support columns 711*a*, 711*b*. In alternative embodiments, the first platform base 721 can connect to fewer than all of the support columns 711, such as only the back support columns 711*c*, 711*d*. The first platform base 721 includes a first platform surface 723 optionally partially covered in an anti-slip material. Similarly, the second platform base 722 has a rectangular shape that is connected to all four support columns 711, extending in a generally horizontal direction. The front of the second platform base does not extend as far horizontally as the first platform base 721. The second platform base 722 includes a second platform surface 724 also partially covered in an anti-slip material. The second platform surface 724 is configured in a stepped relationship with the first platform surface 723.

The frame assembly 710 also includes an upper support bar 716 that extends from the upper ends of the rear support columns 711*c*, 711*d*. The upper support bar 716 is of a generally curved shape and extends towards the front of the shoe tie-assisting device 700. The middle portion of the upper support bar 716 is covered with a gripping material, e.g. a rubber or foam, to create handle section 733. The gripping material allows a user to grip the handles without the risk that their hands will slip off of the handle section 733. The handle section 733 constitutes a handle assembly 730.

At the base of the bottom ends of the support columns 711 are base portions 115. These base portions 715 are preferably made of a material, e.g. a rubber, which can engage several floor surface types with a high degree of friction such that the shoe tie-assisting device 700 does not slide along the floor during use. As depicted, the base portions 715 are end-caps covering the bottom ends of the support columns 711.

Similar to the shoe tie-assisting devices discussed above, the shoe tie-assisting device 700 can be designed to be collapsible to reduce the space it occupies. Additionally, the components of the platform assembly 720 and the handle assembly 730 can be made to be adjustable so that persons of different heights can be comfortably accommodated.

Eighth Embodiment

Figure 8:
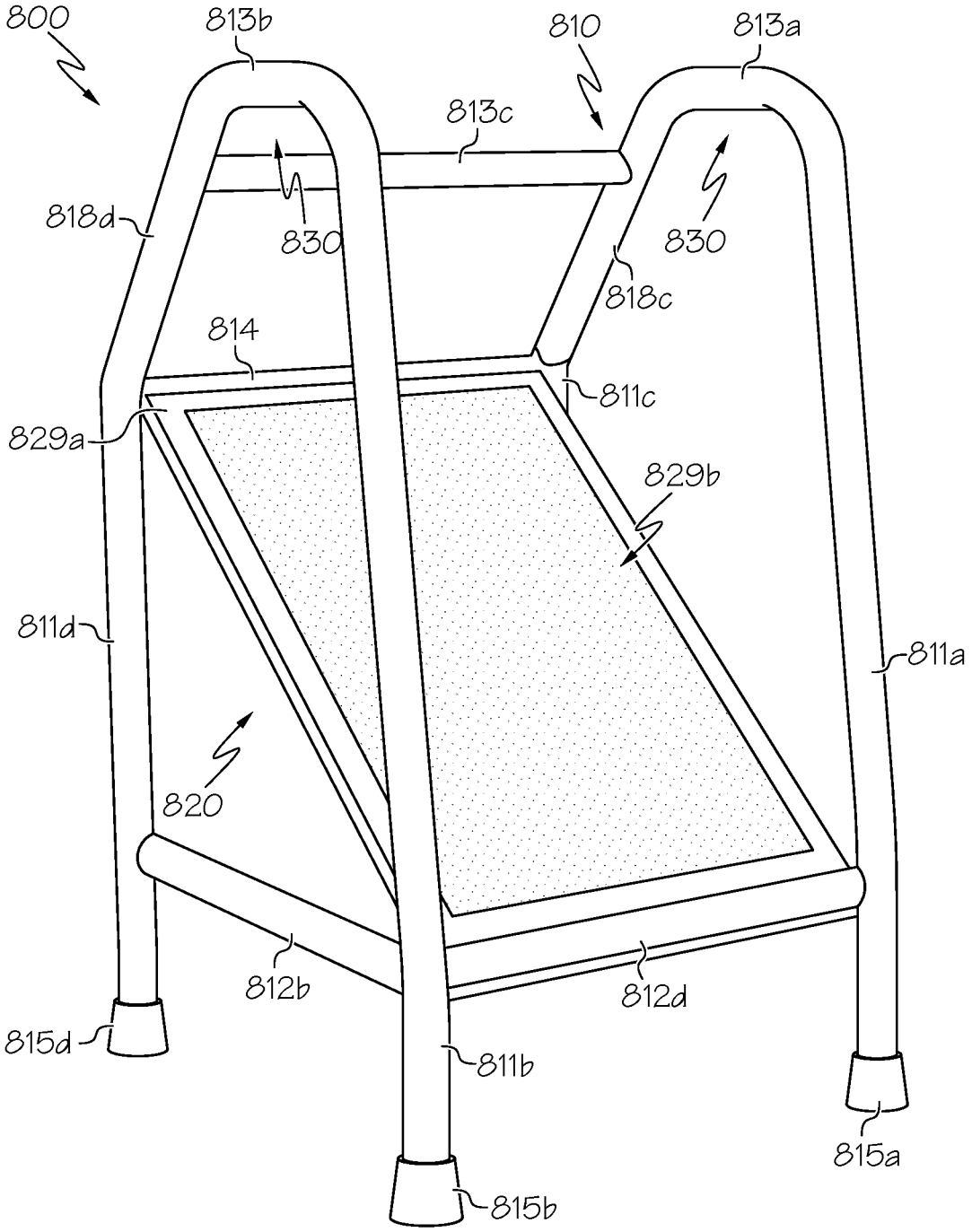
FIG. 8 depicts an isometric view of a shoe tie-assisting device according to an eighth embodiment.

Referring to FIG. 8, a shoe tie-assisting device 800 according to an eighth embodiment has a frame assembly that includes four vertically-extending support columns 811 to create a quadrilateral-shaped space therebetween.

The frame assembly 810 also includes horizontally-extending upper support bars 813, which serve to connect the upper ends of the support columns 811. Specifically, the front right support column 811*a* is connected to the upper section 818*c* of the back right support column 811*c* with right upper support bar 813*a* and the front left support column 811*b* is connected to the upper section 818*d* of the back left support column 811*d* with left upper support bar 813*b*. Additionally, while not disposed at the same height as the right and left upper support bars 813*a*, 813*b*, a rear upper support bar 813*c* connects the upper section 818*c* of the back right support column 811*c* with connects the upper section 818*d* of the back left support column 811*d*. The right and left upper support bars 813*a*, 813*b* together constitute a handle assembly 830 and can each be optionally covered in gripping material (not shown), e.g. a rubber or foam which allows a user to grip the upper support bars 813*a*, 813*b* without the risk that their hands will slip off.

The frame assembly 810 further includes horizontally-extending lower support bars 812, which serve to connect lower ends of the support columns 811. Specifically, the front left support column 811*b* is connected with the rear left support column 811*d* with a left lower support bar 812*b* and the front right support columns 811*a* is connected with the front left support column 811*b* with a front lower support bar 812*d*. Additionally, while hidden from view, the front right support column 811*a* is connected with the rear right support column 811*c* with a right lower support bar (not shown).

The frame assembly 810 additionally includes an intermediate support bar 814 which connects the rear right support column 811*c* with the rear left support column 811*d*.

Extending between the front lower support bar 812*d* and the intermediate support bar 814 is a platform assembly 820 that includes an angled platform surface 829*a* partially covered in an anti-slip material 829*b*.

Similar to the shoe tie-assisting devices discussed above, the shoe tie-assisting device 800 can be designed to be collapsible to reduce the space it occupies. Additionally, the components of the platform assembly 820 and the handle assembly 830 can be made to be adjustable so that persons of different heights can be comfortably accommodated.

Ninth Embodiment

Figure 9:
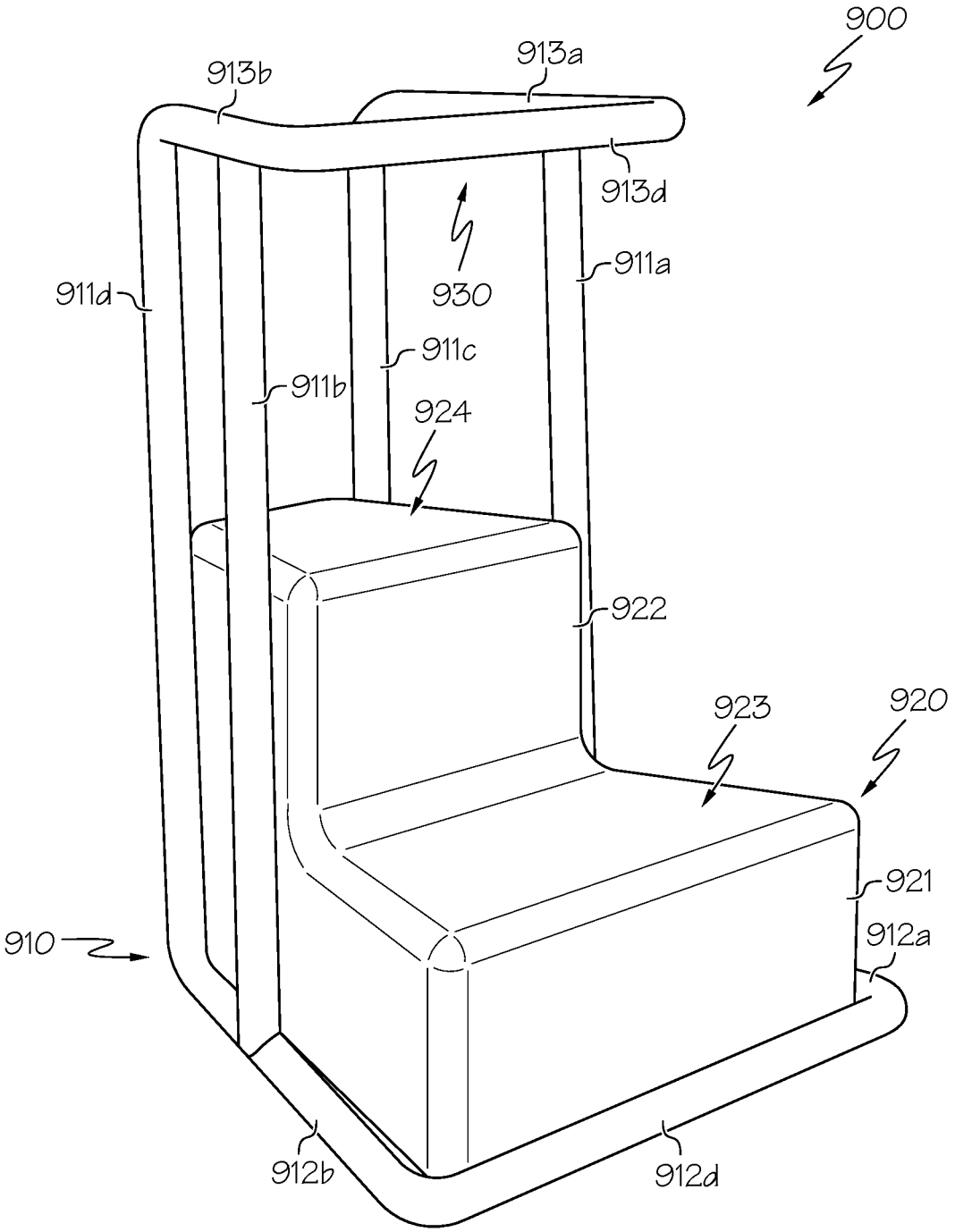
FIG. 9 depicts an isometric view of a shoe tie-assisting device according to a ninth embodiment.

Referring to FIG. 9, a shoe tie-assisting device 900 according to an ninth embodiment has a frame assembly that includes four vertically-extending support columns 911 to create a quadrilateral-shaped space therebetween.

The frame assembly 910 also includes horizontally-extending lower support bars 912, some of which serve to connect lower ends of the support columns 911. Specifically, the front left support column 911*b* is connected with the rear left support column 911*d* with a left lower support bar 912*b* and the front right support column 911*a* is connected with the rear right support column 911*c* with a right lower support bar 912*a*. In addition to connecting adjacent supports columns 911, the lower support bars 912*a*, 912*b* extend past the front support columns 911*a*, 911*b* and are connected with a front lower support bar 912*d*.

Positioned between the lower support bars 912 is a foot-resting platform assembly 920. The platform assembly 920 in the form of a platform base that includes a first, lower base section 921 and a second, upper base section 922. The platform base 921, 922 can be made of a plastic material and resembles a set of stairs and the first base section 921 includes a first platform surface 923. The second base section 922 is disposed above the rear portion of the first base section 921 behind the first platform surface 924, and includes a second platform surface 924. The platform surface 923, 924 can optionally be partially covered in an anti-slip material.

The frame assembly 910 further includes horizontally-extending upper support bars 913, some of which serve to connect upper ends of the support columns 911. Specifically, the front left support column 911*b* is connected with the rear left support column 911*d* with a left upper support bar 913*b* and the front right support column 911*a* is connected with the rear right support column 911*c* with a right upper support bar 913*a*. In addition to connecting adjacent supports columns 911, the upper support bars 913*a*, 913*b* extend past the front support columns 911*a*, 911*b* and are connected with a front upper support bar 913*d*.

Similar to the shoe tie-assisting devices discussed above, the shoe tie-assisting device 900 can be designed to be collapsible to reduce the space it occupies. Additionally, the components of the platform assembly 920 and the handle assembly 930 can be made to be adjustable so that persons of different heights can be comfortably accommodated.

As discussed above, various alternative embodiments to the depicted shoe tie-assisting device embodiments are envisioned. Additionally, it is envisioned that any of the features in any of the above embodiments can be combined with features of any other of the above embodiments and/or any other features disclosed separately.

The invention claimed is:

1. A shoe tie-assisting device comprising:

a frame assembly comprising at least three support columns defining a geometric space therebetween and support bars extending between the support columns such that the support columns are connected;

a platform assembly at least partially disposed within or below the geometric space defined by the support columns, comprising a first platform surface, the first platform surface configured to receive a foot of a user lifted to the platform surface; and a handle assembly comprising:

a first handle or pair of handles connected to the frame assembly and disposed at a height above the platform assembly, wherein the first handle or first pair of handles can be gripped by the hands of a person of typical height while the person is in an upright position; and a second handle or pair of handles disposed below the first handle or pair of handles.

2. The shoe tie-assisting device of claim 1, wherein the first handle or pair of handles is at least 30 inches from a bottom of the shoe tie-assisting device.

3. The shoe tie-assisting device of claim 1, the platform assembly comprising a second platform surface in a stepped relationship with first platform surface.

4. The shoe tie-assisting device of claim 3, wherein the second platform surface is disposed above the first platform surface, wherein the first platform surface extends further in a horizontal direction than the second platform surface.

5. The shoe tie-assisting device of claim 1, wherein the second handle or pair of handles extends from the frame assembly outside of the geometric space defined by the support columns.

6. The shoe tie-assisting device of claim 1, wherein the second handle or pair of handles extends further in a horizontal direction than the platform assembly.

7. The shoe tie-assisting device of claim 5, wherein the first handle or pair of handles extends from the frame assembly outside of the geometric space defined by the support columns.

8. The shoe tie-assisting device of claim 1, wherein the first handle or pair of handles extends further in a horizontal direction than the platform assembly.

9. The shoe tie-assisting device of claim 1, wherein the first handle or pair of handles is disposed above the geometric space defined by the support columns.

10. The shoe tie-assisting device of claim 9, wherein the first handle or pair of handles is a first handle connected to a support bar that extends upwards from and between two of the support columns.

11. A method for tying or untying shoes using the device of claim 1, comprising the steps of:

(i) a user gripping the first handle or one of the first pair of handles with one of their hands, (ii) the user thereafter lifting a foot to the first platform surface, (iii) the user thereafter lowering their upper body towards the first platform surface, (iv) the user thereafter moving one of their hands toward their foot and tying or untying a shoe on the foot.

12. The method of claim 11, step (iii) further comprising the user moving one of their hands to one of a second pair of handles, thereby causing their upper body to lower towards the first platform surface.

13. The method of claim 12, further comprising a step of the user moving the other hand to the other of a second pair of handles.

14. The method of claim 11, further comprising a step of the user raising the foot to a second platform surface from the first platform surface prior to step (iv).

15. The method of claim 11, further comprising a step (v) after step (iv) a step of the user removing the foot from the shoe-tie assisting device.

16. The method of claim 15, further comprising a step (vi) after step (v) of the user placing their other foot on the first platform assembly and tying or untying a shoe.

17. The shoe tie-assisting device of claim 1, further comprising a base portion to engage a floor surface with sufficient friction to prevent the device from sliding on the floor surface during use.

* * * * *